US008049435B2

(12) United States Patent
Kimura

(10) Patent No.: US 8,049,435 B2
(45) Date of Patent: Nov. 1, 2011

(54) FREQUENCY SYNCHRONIZING METHOD FOR DISCHARGE TUBE LIGHTING APPARATUS, DISCHARGE TUBE LIGHTING APPARATUS, AND SEMICONDUCTOR INTEGRATED CIRCUIT

(75) Inventor: Kengo Kimura, Niiza (JP)

(73) Assignee: Sanken Electric Co., Ltd., Niiza-shi (JP)

( * ) Notice: Subject to any disclaimer, the term of this patent is extended or adjusted under 35 U.S.C. 154(b) by 428 days.

(21) Appl. No.: 12/302,617

(22) PCT Filed: Sep. 10, 2007

(86) PCT No.: PCT/JP2007/067611

§ 371 (c)(1), (2), (4) Date: Nov. 26, 2008

(87) PCT Pub. No.: WO2008/044413

PCT Pub. Date: Apr. 17, 2008

(65) Prior Publication Data

US 2009/0243505 A1 Oct. 1, 2009

(30) Foreign Application Priority Data

Oct. 5, 2006 (JP) ..... 2006-274214

(51) Int. Cl.
*H05B 41/14* (2006.01)

(52) U.S. Cl. ..... 315/291; 315/317; 315/248; 315/250; 315/224; 315/276

(58) Field of Classification Search ..... 315/291, 315/307, 308, 224, 248, 250, 207; 345/102
See application file for complete search history.

(56) References Cited

U.S. PATENT DOCUMENTS

| | | | | |
|---|---|---|---|---|
| 5,615,093 | A | 3/1997 | Nalbant | |
| 5,936,358 | A | 8/1999 | Okamoto et al. | |
| 6,198,198 | B1 | 3/2001 | Fujimura et al. | |
| 2003/0071586 | A1 * | 4/2003 | Lin et al. | 315/291 |
| 2005/0128775 | A1 * | 6/2005 | Fukumoto | 363/65 |
| 2005/0156536 | A1 * | 7/2005 | Ball | 315/291 |

FOREIGN PATENT DOCUMENTS

| | | |
|---|---|---|
| JP | 10 50491 | 2/1998 |
| JP | 10 97898 | 4/1998 |
| JP | 10 285942 | 10/1998 |
| JP | 2002 319499 | 10/2002 |
| JP | 2005 5059 | 1/2005 |

* cited by examiner

*Primary Examiner* — Douglas W Owens
*Assistant Examiner* — Jonathan Cooper
(74) *Attorney, Agent, or Firm* — Oblon, Spivak, McClelland, Maier & Neustadt, L.L.P.

(57) ABSTRACT

An oscillator generates a triangular wave signal whose inclination for charging a capacitor and inclination for discharging the same are the same and which is used to turn on/off FETs Qp1 and Qn1. A signal generation part generates first drive signal in a period shorter than a half period of the triangular wave signal to drive the Qp1, and generates a second drive signal having a pulse width substantially equal to that of the first drive signal and a phase difference of about 180 degrees with respect to the first drive signal, to drive the Qn1 and provide a current to the discharge tube in a direction opposite to the current driven by the first drive signal. Furthermore a pulse current generation circuit converts a synchronization pulse voltage signal into a pulse current that alternates between positive and negative current values.

11 Claims, 18 Drawing Sheets

FREQUENCY SYNCHRONIZING METHOD FOR DISCHARGE TUBE LIGHTING APPARATUS, DISCHARGE TUBE LIGHTING APPARATUS, AND SEMICONDUCTOR INTEGRATED CIRCUIT

TECHNICAL FIELD

The present invention relates to a frequency synchronizing method for a discharge tube lighting apparatus used to light a discharge tube, in particular, one used for a liquid crystal display device employing a cold cathode tube. It also relates to a discharge tube lighting apparatus and a semiconductor integrated circuit.

BACKGROUND TECHNOLOGY

FIG. 1 is a circuit diagram illustrating a configuration of a conventional discharge tube lighting apparatus with no synchronization signal being inputted thereto. FIG. 2 is a timing chart illustrating signals at various parts of the conventional discharge tube lighting apparatus with no synchronization signal being input thereto. In the discharge tube lighting apparatus as illustrated in FIG. 1, connected between a DC power source Vin and the ground is a first series circuit having a high-side p-type MOSFET Qp1 (referred to as p-type FET Qp1) and a low-side n-type MOSFET Qn1 (referred to as n-type FET Qn1). Between a connection point of the p-type FETQp1 and n-type FET Qn1 and the ground GND, there is connected a series circuit having a capacitor C3 and a primary winding P of a transformer T. Both ends of a secondary winding S of the transformer T are connected to a series circuit having a reactor Lr and a capacitor C4

A source of the p-type FET Qp1 receives the DC power source Vin and a gate of the p-type FET Qp1 is connected to a terminal DRV1 of a controller IC 1. A gate of the n-type FET Qn1 is connected to a terminal DRV2 of the controller IC 1.

The controller IC 1 has a start circuit 10, a constant current determination circuit 11, an oscillator 12, a frequency divider 13, an error amplifier 15, a PWM comparator 16, a NAND gate 17*a*, an AND gate 17*b*, and drivers 18*a* and 18*b*. The constant current determination circuit 11 is connected through a terminal RF to an end of a constant current determination resistor R1. The oscillator 12 is connected through a terminal CF to an end of a capacitor C1.

The start circuit 10 receives source power from the DC power source Vin to generate a predetermined voltage REG and supply the same to various internal parts. The constant current determination circuit 11 passes a constant current that is optionally set by the constant current determination resistor R1. According to the constant current from the constant current determination circuit 11, the oscillator 12 charges and discharges the capacitor C1, to generate a sawtooth oscillating waveform illustrated in FIG. 2 (illustrated in FIG. 2 is a charge/discharge voltage of the capacitor C1 at the terminal CF), and according to the sawtooth oscillating waveform, generates a clock CK. The clock CK has, as illustrated in FIG. 2, a pulse voltage waveform that is synchronized with the sawtooth oscillating waveform at the terminal CF so that it becomes high level during a rise period of the sawtooth oscillating waveform and low level during a fall period of the same. The clock CK is sent to the frequency divider 13.

An end of the secondary winding S of the transformer T is connected through the reactor Lr to an electrode of a discharge tube 3, the other electrode of the discharge tube 3 being connected to a tube current detection circuit 5. The tube current detection circuit 5 has diodes D1 and D2 and resistors R3 and R4, to detect a current passing through the discharge tube 3 and output a voltage proportional to the detected current to an inverting terminal (as depicted by "−") of the error amplifier 15 through a feedback terminal FB of the controller IC 1.

The error amplifier 15 amplifiers an error voltage FBOUT between the voltage from the tube current detection circuit 5 input to the inverting terminal and a reference voltage E1 input to a non-inverting terminal (as depicted by "+") and sends the error voltage FBOUT to a non-inverting terminal (as depicted by "+") of the PWM comparator 16. The PWM comparator 16 generates a pulse signal that is high level if the error voltage FBOUT from the error amplifier 15 inputted to the non-inverting terminal is equal to or higher than the sawtooth waveform voltage from the terminal CF input to a non-inverting terminal (as depicted by "+") and low level if the error voltage FBOUT is lower than the sawtooth waveform voltage. The pulse signal is outputted to the NAND gate 17*a* and AND gate 17*b*.

The frequency divider 13 divides the frequency of the pulse signal from the oscillator 12 and provides the NAND gate 17*a* with a frequency-divided pulse signal Q and the AND gate 17*b* with a pulse signal (having a predetermined dead time with respect to the frequency-divided pulse signal Q) formed by inverting the frequency-divided pulse signal Q. The NAND gate 17*a* operates the NAND function of the frequency-divided pulse signal from the frequency divider 13 and the signal from the PWM comparator 16 and outputs a drive signal through the driver 18*a* and terminal DRV1 to the p-type FET Qp1. The AND gate 17*b* operates the AND function of the inverted frequency-divided pulse signal from the frequency divider 13 and the signal from the PWM comparator 16 and outputs a drive signal through the driver 18*b* and terminal DRV2 to the n-type FET Qn1.

During from time t1 to t2, for example, the output from the PWM comparator 16 is high level, the output from the frequency divider 13 is high level, and the output of the NAND gate 17*a* is low level. As a result, the terminal DRV1 provides a low-level output to turn on the p-type FET Qp1. From time t4 to t5, the output from the PWM comparator 16 is high level, the inverted output from the frequency divider 13 is high level, and the output from the AND gate 17*b* is high level. As a result, the terminal DRV2 provides a high-level outputted to turn on the n-type FET Qn1.

Namely, the drive signals are formed by synthesis with the outputs from the frequency divider 13 and are alternately sent to the terminals DRV1 and DRV2 in synchronization with the clock CK with a fall period of the sawtooth oscillating waveform serving as a dead time. With the above-mentioned operation, the controller IC 1 alternately turns on/off the p-type FET Qp1 and n-type FET Qn1 at the frequency of the sawtooth oscillating waveform. As results, power is supplied to the discharge tube 3 and a current passing through the discharge tube 3 is controlled at a predetermined value.

The oscillation frequency of the oscillator 12 arranged in the discharge tube lighting apparatus illustrated in FIG. 1 is generally determined by the resistor R1 and capacitor C1. However, due to variations among the employed parts (the resistor and capacitor), the oscillation frequency may interfere with a low oscillation frequency of burst dimming and the oscillation frequency of an SMPS arranged before the discharge tube lighting apparatus, to cause screen flickering that is critical for a display device.

To cope with this, there is a method that inputs an external synchronization pulse voltage signal to the discharge tube lighting apparatus, to synchronize and regulate the oscillation frequency of the oscillator 12 with respect to the external synchronization pulse voltage signal. In this case, the lighting frequency of a discharge tube is synchronized with the frequency of the external synchronization pulse voltage signal, or ½ of the frequency of the external synchronization pulse voltage signal. For example, to synchronize the lighting frequency of a discharge tube with a synchronization pulse voltage signal from a microcomputer, a synchronization circuit illustrated in FIG. 3 is added.

The synchronization circuit illustrated in FIG. 3 has a one-shot circuit 2 to generate a one-shot pulse at a rise time of an external synchronization pulse voltage signal TRI, a diode D3 connected to an output of the one-shot circuit 2 and an end of a capacitor C1, and a Zener diode ZD1 connected to both ends of the capacitor C1. This synchronization circuit provides the capacitor C1 with the synchronization pulse voltage signal TRI whose frequency is higher than the frequency of a sawtooth oscillating waveform CF of the capacitor C1, as illustrated in FIG. 4, to synchronize the sawtooth oscillating waveform CF of the capacitor C1 with the frequency of the synchronization pulse voltage signal TRI, thereby synchronizing the lighting frequency of the discharge tube 3 with ½ of the frequency of the synchronization pulse voltage signal TRI.

A known related art is, for example, U.S. Pat. No. 5,615,093. According to this document, a secondary winding of a transformer is connected to a load. A primary winding of the transformer is provided with a semiconductor switch circuit. Each switch of the semiconductor switch circuit is PWM-controlled to conduct constant-current control. If a state of instructing the stoppage of an operation/stop signal is established, a power source to a control circuit part is disconnected to set a standby state. At the same time, switch drive signals that turn on the switches in the semiconductor switch circuit are turned off, to prevent the occurrence of an excessive current at the time of shifting to the standby state.

DISCLOSURE OF INVENTION

However, the frequency synchronizing method for a discharge tube lighting apparatus according to the related art illustrated in FIG. 3 will break the continuity of a triangular waveform, as illustrated in FIG. 5, if the frequency of the synchronization pulse signal TRI is lower than the frequency of the sawtooth oscillating waveform CF of the capacitor C1. Then, the two drive signals will have pulse widths that are different from each other and phases that have a phase difference other than 180 degrees. In the drawing, the drive signal at the terminal DRV2 and the drive signal at the terminal DRV1 have different pulse widths and a phase difference other than 180 degrees. This causes an imbalance in currents passing through the discharge tube, biases a mercury distribution in the discharge tube, creates a brightness inclination, and shortens a service life.

The present invention provides a frequency synchronizing method for a discharge tube lighting apparatus, a discharge tube lighting apparatus, and a semiconductor integrated circuit, capable of performing synchronization even if the frequency of a synchronization pulse voltage signal is higher or lower than the oscillation frequency of an oscillator, expanding a frequency band of pulse voltage signals usable for synchronization, and stably and easily synchronizing an oscillation frequency with a synchronization pulse voltage signal.

Means to Solve the Problems

To solve the above-mentioned problems, the present invention provides a frequency synchronizing method for a discharge tube lighting apparatus having a resonant circuit including a capacitor connected to at least one of primary and secondary windings of a transformer, an output of the resonant circuit being connected to a discharge tube, and a plurality of switching elements of bridge configuration connected to both ends of a DC power source, to pass a current through the primary winding of the transformer and the capacitor. The method includes generating a triangular wave signal whose inclination for charging an oscillator capacitor and inclination for discharging the same are the same and which is used to turn on/off the plurality of switching elements; generating, in a period shorter than a half period of the triangular wave signal, a first drive signal having a pulse width corresponding to a current passing through the discharge tube, to drive a first group of one or more switching elements among the plurality of switching elements and provide a current to the discharge tube; generating a second drive signal having a pulse width substantially equal to that of the first drive signal and a phase difference of about 180 degrees with respect to the first drive signal, to drive a second group of one or more switching elements among the plurality of switching elements and provide a current to the discharge tube in a direction opposite to the current driven by the first drive signal; and converting a synchronization pulse voltage signal into a pulse current that alternates between positive and negative current values of the same absolute value at a duty of about 50% and superimposing the pulse current on the triangular wave signal of the oscillator, to generate a modulated pulse current. Generating the first drive signal and generating the second drive signal generate the first and second drive signals in synchronization with the frequency of the modulated pulse.

The present invention also provides a discharge tube lighting apparatus that converts a direct current into a positive-negative symmetrical alternating current and supplies power to a discharge tube. The apparatus comprises a resonant circuit including a capacitor connected to at least one of primary and secondary windings of a transformer, an output of the resonant circuit being connected to the discharge tube; a plurality of switching elements of bridge configuration connected to both ends of a DC power source, to pass a current through the primary winding of the transformer and the capacitor; an oscillator to generate a triangular wave signal whose inclination for charging an oscillator capacitor and inclination for discharging the same are the same and which is used to turn on/off the plurality of switching elements; a signal generation part to generate, in a period shorter than a half period of the triangular wave signal, a first drive signal having a pulse width corresponding to a current passing through the discharge tube, to drive a first group of one or more switching elements among the plurality of switching elements and provide a current to the discharge tube, as well as generating a second drive signal having a pulse width substantially equal to that of the first drive signal and a phase difference of about 180 degrees with respect to the first drive signal, to drive a second group of one or more switching elements among the plurality of switching elements and provide a current to the discharge tube in a direction opposite to the current driven by the first drive signal; and a pulse current generation circuit to convert a synchronization pulse voltage signal into a pulse current that alternates between positive and negative current values of the same absolute value at a duty of about 50% and superimpose the pulse current on the triangular wave signal of the oscillator. The signal generation part generates the first drive signal and second drive signal in synchronization with the frequency of the pulse current from the pulse current generation circuit.

The present invention also provides a semiconductor integrated circuit that controls a plurality of switching elements of bridge configuration to supply power to a discharge tube. The semiconductor integrated circuit comprises an oscillator to generate a triangular wave signal whose inclination for charging an oscillator capacitor and inclination for discharging the same are the same and which is used to turn on/off the plurality of switching elements; a signal generation part to generate, in a period shorter than a half period of the triangular wave signal, a first drive signal having a pulse width corresponding to a current passing through the discharge tube, to drive a first group of one or more switching elements among the plurality of switching elements and provide a current to the discharge tube, as well as generating a second drive signal having a pulse width substantially equal to that of the first drive signal and a phase difference of about 180 degrees with respect to the first drive signal, to drive a second group of one or more switching elements among the plurality of switching elements and provide a current to the discharge tube in a direction opposite to the current driven by the first drive signal; an input terminal to which a synchronization pulse voltage signal is input; and a pulse current generation circuit to convert the synchronization pulse voltage signal inputted to the input terminal into a pulse current that alternates between positive and negative current values of the same absolute value at a duty of about 50% and superimpose the pulse current on the triangular wave signal of the oscillator. The signal generation part generates the first drive signal and second drive signal in synchronization with the frequency of the pulse current from the pulse current generation circuit.

BEST MODE OF IMPLEMENTING INVENTION

Frequency synchronizing methods for discharge tube lighting apparatuses, discharge tube lighting apparatuses, and semiconductor integrated circuits according to embodiments of the present invention will be explained in detail with reference to the drawings.

Embodiment 1

Figure 1:
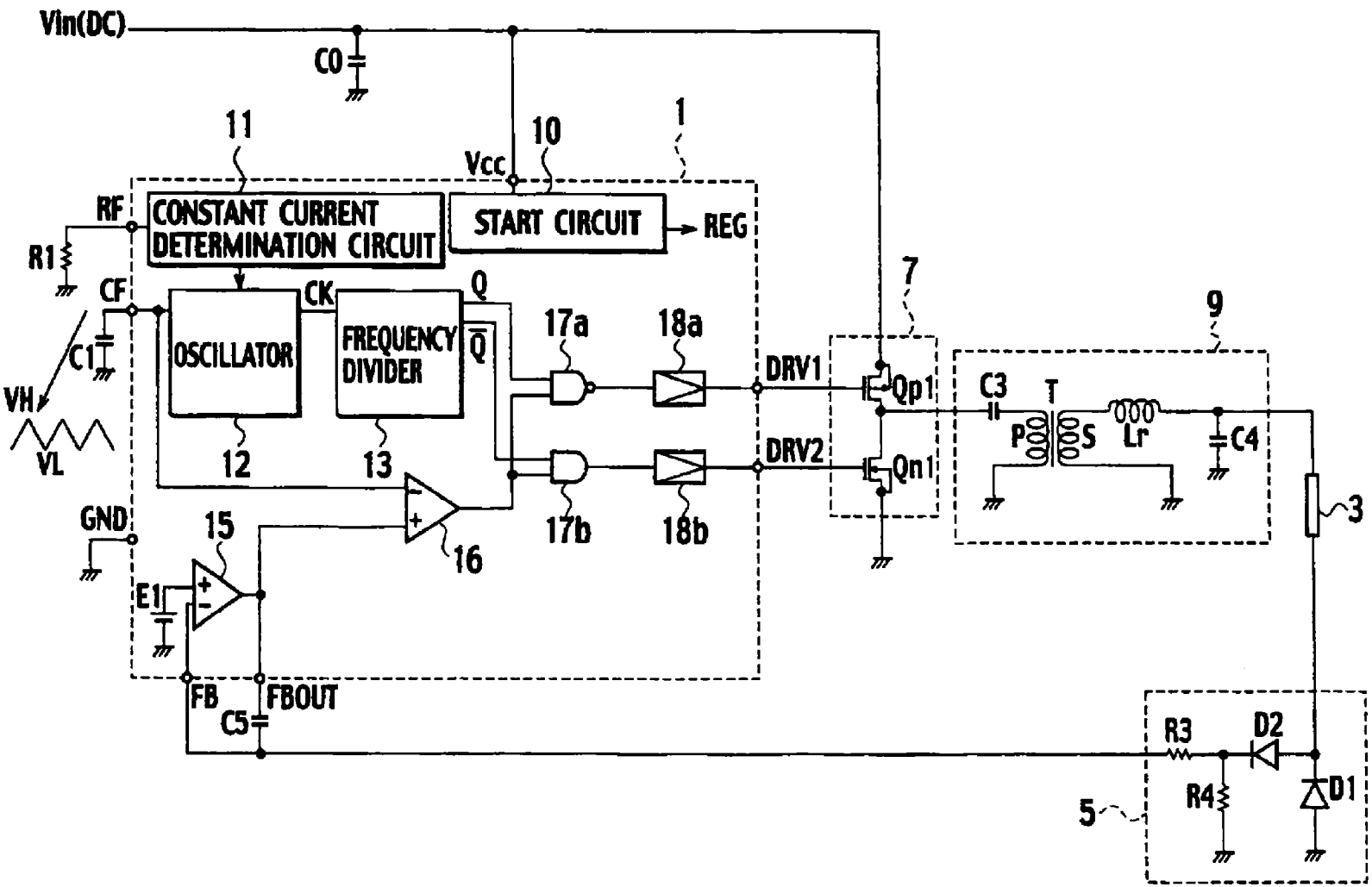
FIG. 1 BACKGROUND ART
FIG. 1 is a circuit diagram illustrating a configuration of a related discharge tube lighting apparatus with no synchronization pulse voltage signal being input thereto.
Figure 2:
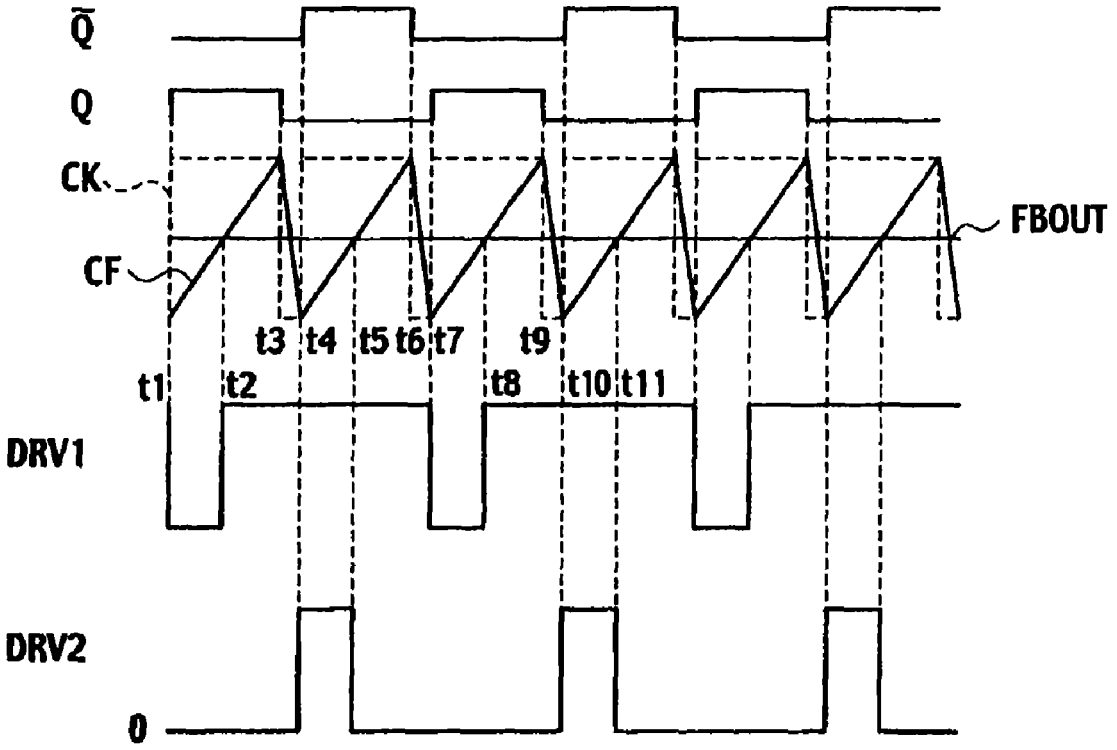
FIG. 2 BACKGROUND ART
FIG. 2 is a timing chart illustrating signals at various parts of the related discharge tube lighting apparatus with no synchronization pulse voltage signal being inputted thereto.
Figure 3:
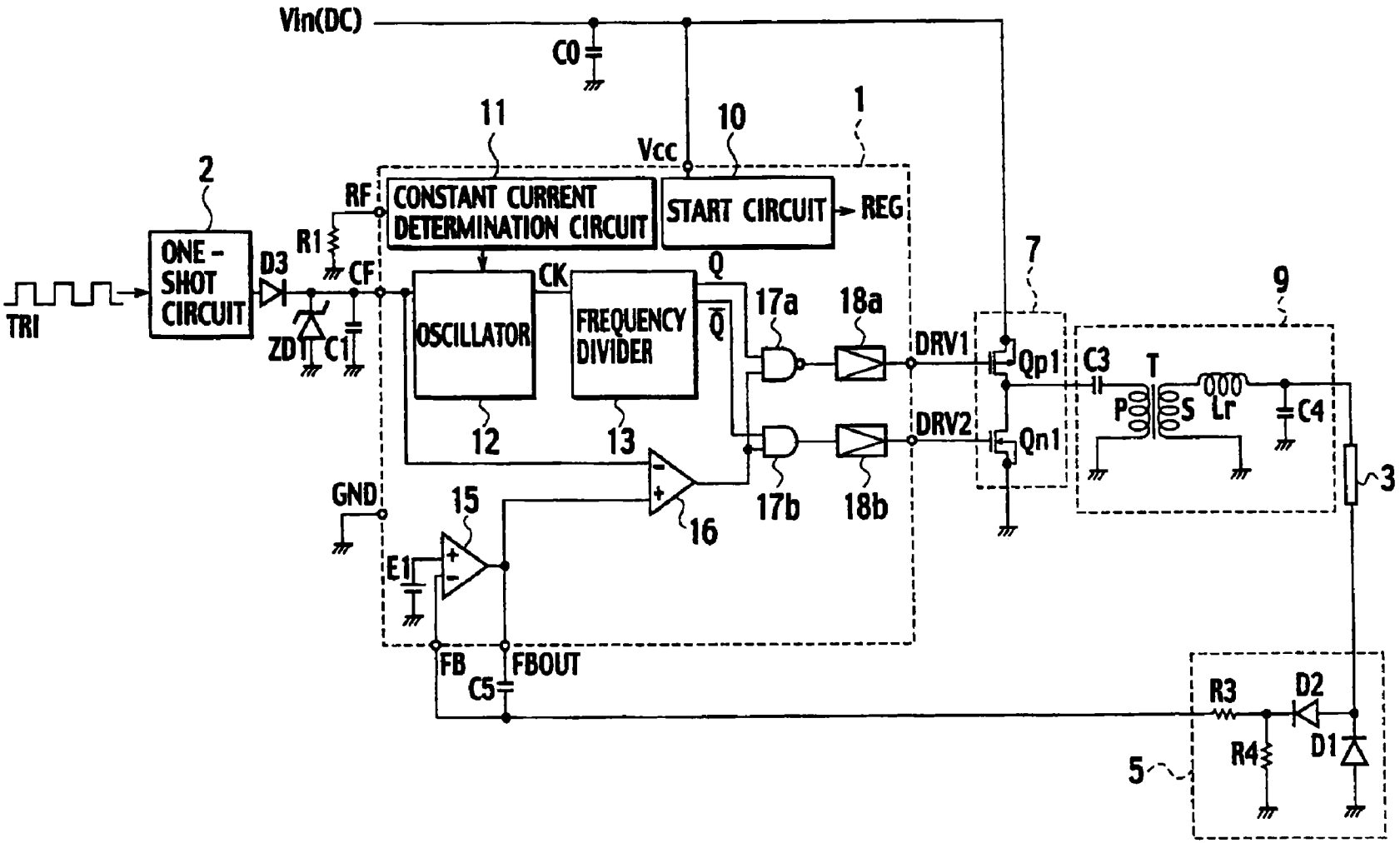
FIG. 3 BACKGROUND ART
FIG. 3 is a circuit diagram illustrating a configuration of a related discharge tube lighting apparatus with a synchronization pulse voltage signal being input thereto.
Figure 4:
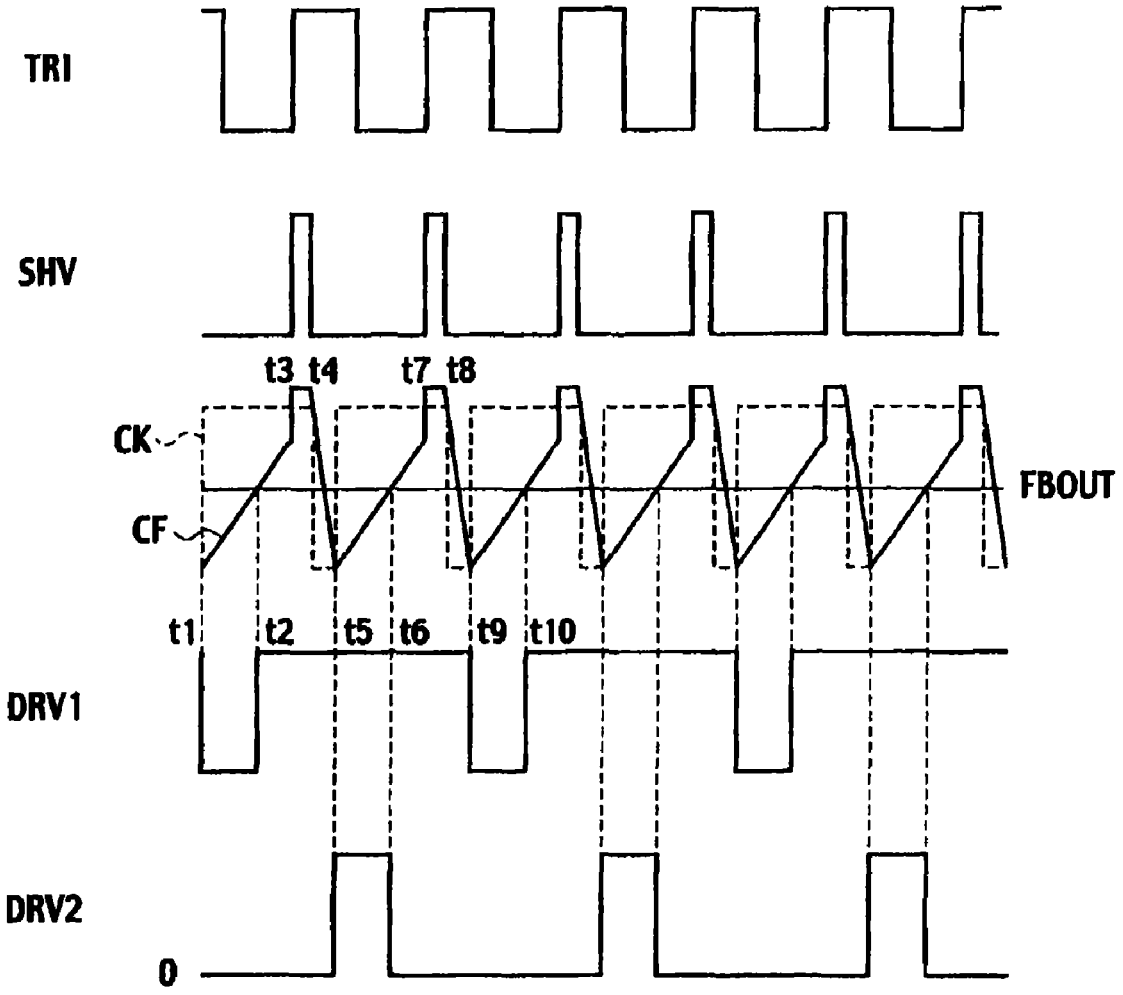
FIG. 4 BACKGROUND ART
FIG. 4 is a timing chart illustrating signals at various parts of the related discharge tube lighting apparatus with a synchronization pulse voltage signal being inputted thereto.
Figure 5:
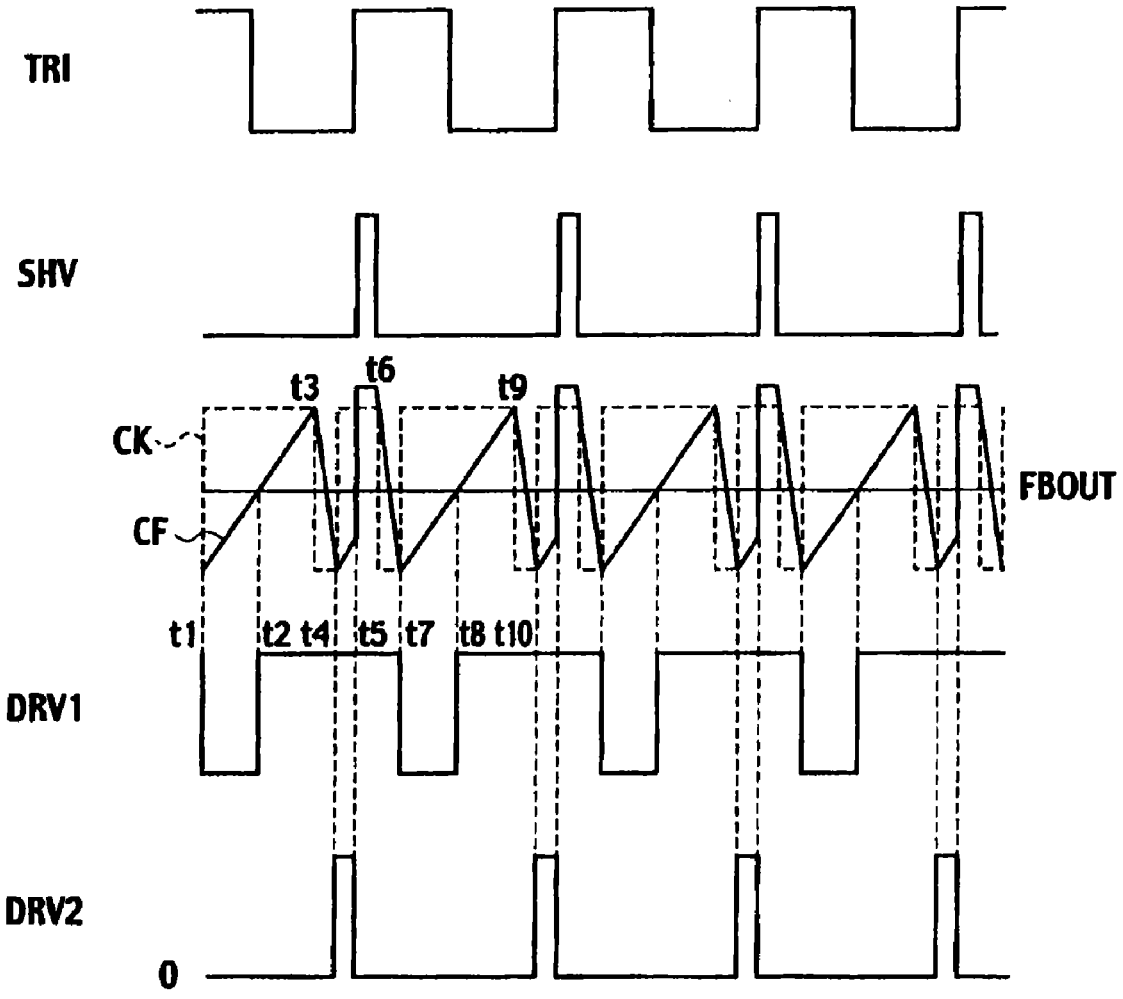
FIG. 5 BACKGROUND ART
FIG. 5 is a timing chart illustrating signals at various parts of the related discharge tube lighting apparatus with a synchronization pulse voltage signal being input thereto, the frequency of the synchronization pulse voltage signal being lower than the frequency of a sawtooth oscillating waveform of a capacitor.
Figure 6:
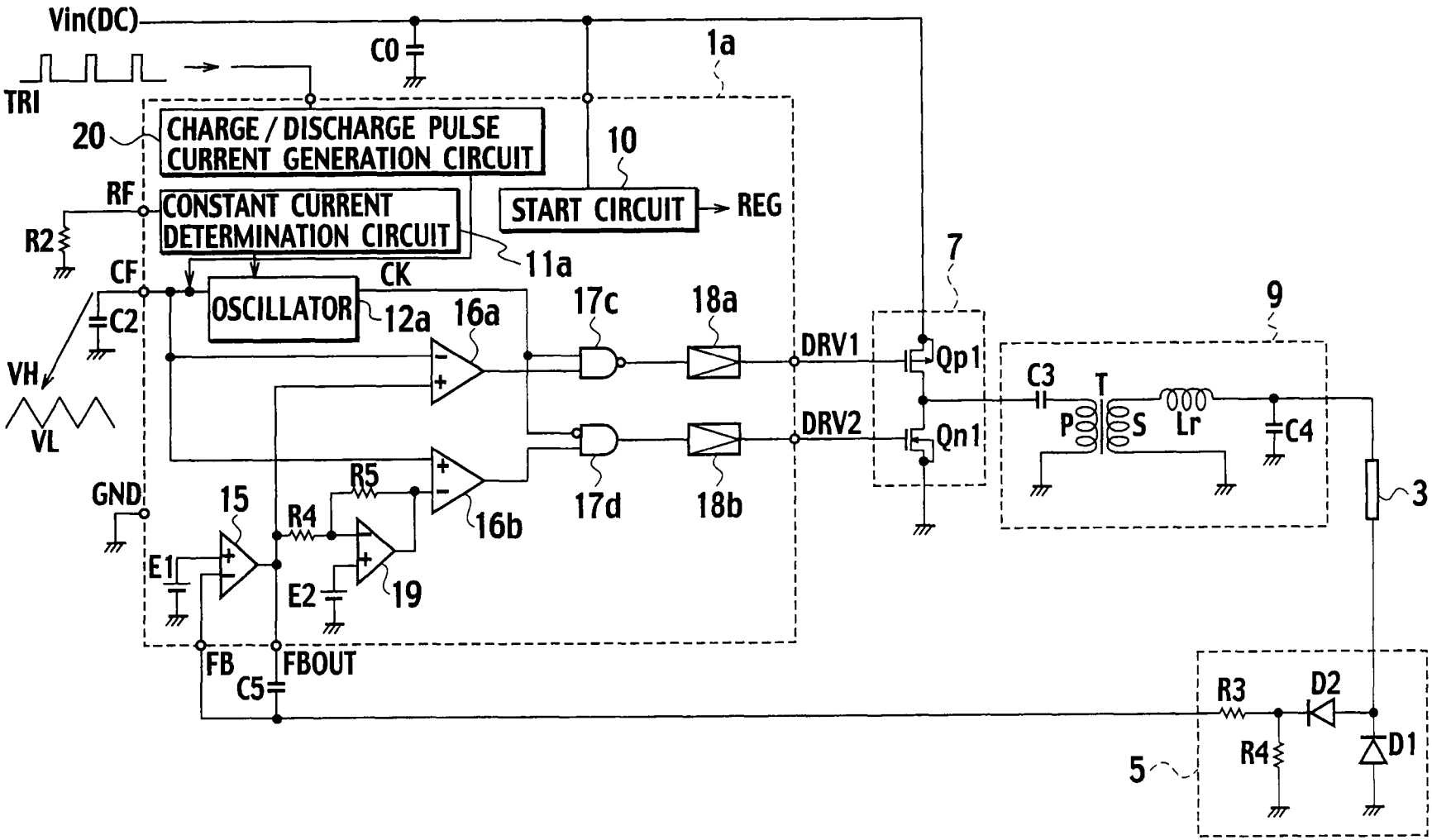
FIG. 6 is a circuit diagram illustrating a configuration of a discharge tube lighting apparatus according to Embodiment 1 of the present invention.

FIG. 6 is a circuit diagram illustrating a configuration of a discharge tube lighting apparatus according to Embodiment 1 of the present invention. The discharge tube lighting apparatus illustrated in FIG. 6 differs from the discharge tube lighting apparatus illustrated in FIG. 1 only in that it employs a controller IC 1*a*. The remaining configuration illustrated in FIG. 6 is the same as the configuration illustrated in FIG. 1, and therefore, the same parts are represented with the same reference marks and explanations thereof are omitted. Only the different part will be explained.

The controller IC 1*a* corresponds to the semiconductor integrated circuit of the present invention and has a charge-discharge pulse current generation circuit 20, a start circuit 10, a constant current determination circuit 11*a*, an oscillator 12*a*, an error amplifier 15, a subtraction circuit 19, PWM comparators 16*a* and 16*b*, a NAND gate 17*c*, a logic gate 17*d*, and drivers 18*a* and 18*b*. A configuration of the start circuit 10 is the same as that illustrated in FIG. 18. The constant current determination circuit 11*a* is connected through a terminal RF to an end of a constant current determination resistor R2. The oscillator 12*a* is connected through a terminal CF to an end of a capacitor C2.

The constant current determination circuit 11*a* provides a constant current that is optionally set by the constant current determination resistor R2. The oscillator 12*a* charges and discharges the capacitor C2 with the constant current from the constant current determination circuit 11*a*, generates a triangular wave signal, and based on the triangular wave signal, generates a clock CK to be sent to the NAND gate 17*c* and logic gate 17*d*. The triangular wave signal has the same rise and fall inclinations. The rise and fall inclinations are set according to a value of the capacitor C2 and a value of the resistor R2.

An output terminal of the error amplifier 15 is connected to a non-inverting terminal (as depicted by "+") of the PWM comparator 16*a* and through a resistor R4 to an inverting terminal (as depicted by "−") of the subtraction circuit 19. Between the inverting terminal and an output terminal of the subtraction circuit 19, there is connected a resistor R5. The subtraction circuit 19 inverts an error voltage FBOUT received from the error amplifier 15 through the resistor R4 with respect to a reference voltage E2 at a non-inverting terminal (as depicted by "+"), i.e., a midpoint potential between an upper limit value and a lower limit value of the triangular wave signal and outputs the inverted voltage, i.e., an inverted waveform of the error voltage FBOUT to a negative terminal (as depicted by "−") of the PWM comparator 16*b*. The reference voltage E2 is expressed as E2=(VL+VH)/2 and is the midpoint potential between the upper limit value VH and lower limit value VL of the triangular wave signal CF.

The PWM comparator 16*a* generates a pulse signal that is high level when the error voltage FBOUT input to the non-inverting terminal from the error amplifier 15 is equal to or higher than the triangular wave signal voltage input to the inverting terminal from the terminal CF and low level when the error voltage FBOUT is lower than the triangular wave signal voltage and outputs the pulse signal to the NAND gate 17*c*. The PWM comparator 16*b* generates a pulse signal that is high level when the triangular wave signal voltage inputted to the non-inverting terminal from the terminal CF is equal to or higher than the inverted waveform voltage of the error voltage FBOUT input to the inverting terminal from the subtraction circuit 19 and low level when the triangular wave signal voltage is lower than the inverted waveform voltage of the error voltage FBOUT and outputs the pulse signal to the logic gate 17*d*.

The NAND gate 17*c* operates the NAND function of the clock from the oscillator 12*a* and the signal from the PWM comparator 16*a* and outputs a first drive signal through the driver 18*a* and a terminal DRV1 to a p-type FET Qp1. The logic gate 17*d* operates the AND function of an inverted signal of the clock from the oscillator 12*a* and the signal from the PWM comparator 16*b* and outputs a second drive signal through the driver 18*b* and a terminal DRV2 to an n-type FET Qn1.

The PWM comparator 16*a*, NAND gate 17*c*, and driver 18*a* correspond to the signal generation part of the present invention that generates, in a period shorter than a half period of the triangular wave signal, the first drive signal having a pulse width corresponding to a current passed to the discharge tube 3, to drive the p-type FET Qp1 and pass a current through the discharge tube 3. The subtraction circuit 19, PWM comparator 16*b*, NAND gate 17*d*, and driver 18*b* correspond to the signal generation part of the present invention that generates the second drive signal having a pulse width substantially equal to that of the first drive signal and a phase difference of about 180 degrees with respect to the first drive signal, to drive the n-type FET Qn1 and provide a current to the discharge tube 3 in a direction opposite to the current driven by the first drive signal.

The charge/discharge pulse current generation circuit 20 converts an external synchronization pulse voltage signal TRI into a pulse current that alternates between positive and negative current values of the same absolute value at a duty of 50% (or about 50%) and that has a frequency formed by halving the frequency of the synchronization pulse voltage signal and superimposes the pulse current on the triangular wave signal of the oscillator 12*a*. The signal generation part generates the first and second drive signals in synchronization with the halved frequency of the pulse current from the charge/discharge pulse current generation part 20. Namely, the oscillation frequency is synchronized with the ½ frequency of the synchronization pulse voltage signal, so that a lighting frequency of the discharge tube 3 is synchronized with the ½ frequency of the synchronization pulse voltage signal.

Figure 7:
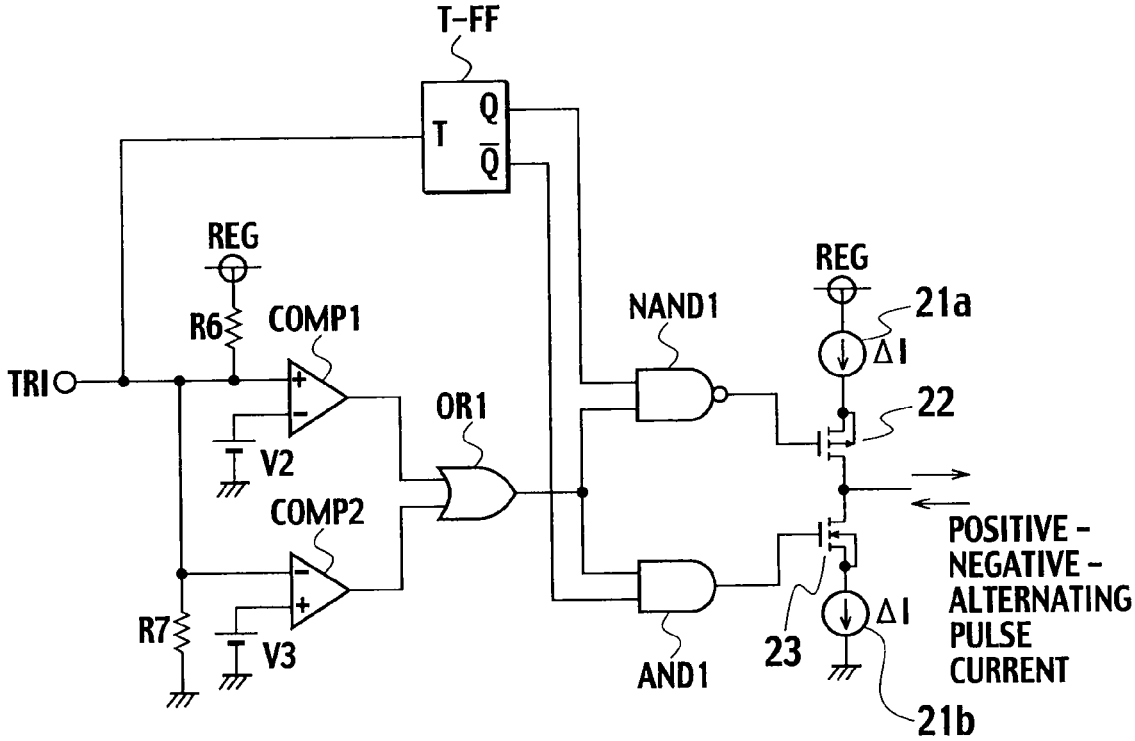
FIG. 7 is a circuit diagram illustrating a configuration of a charge/discharge pulse current generation circuit arranged in the discharge tube lighting apparatus according to Embodiment 1 of the present invention.

FIG. 7 is a circuit diagram illustrating a configuration of the charge/discharge pulse current generation circuit arranged in the discharge tube lighting apparatus according to Embodiment 1 of the present invention. The charge/discharge pulse current generation circuit 20 has a T-type flip-flop circuit T-FF, a series circuit of resistors R6 and R7 connected between a power source REG and the ground GND, a comparator COMP1 whose positive terminal (as depicted by "+") is connected through the resistor R6 to the power source REG and whose negative terminal (as depicted by "−") is connected to a reference voltage V2, a comparator COMP2 whose negative terminal (as depicted by "−") is connected through the resistor R7 to the ground GND and whose positive terminal (as depicted by "+") is connected to a reference voltage V3, an OR gate OR1, a NAND gate NAND1, an AND gate AND1, and a series circuit of a constant current source 21*a*, a p-type FET 22, a constant current source 21*b*, and an n-type FET 23 connected between the power source REG and the ground GND.

The reference voltages V2 and V3 are set to satisfy a relationship of V3<(voltage of REG)×R7/(R6+R7)<V2.

The reason why the comparators COMP1 and COMP2 and the OR gate OR1 are arranged is to set TRI terminal voltage is equal to (voltage of REG)×R7/(R6+R7) when no signal is present at a TRI terminal (the terminal being open), so that no positive or negative pulse current is passed therethrough. A dead band is set so that the comparators COMP1 and COMP2 provide no output when a signal that is larger than the reference voltage V3 and smaller than the reference voltage V2 is input to the TRI terminal.

Figure 8:
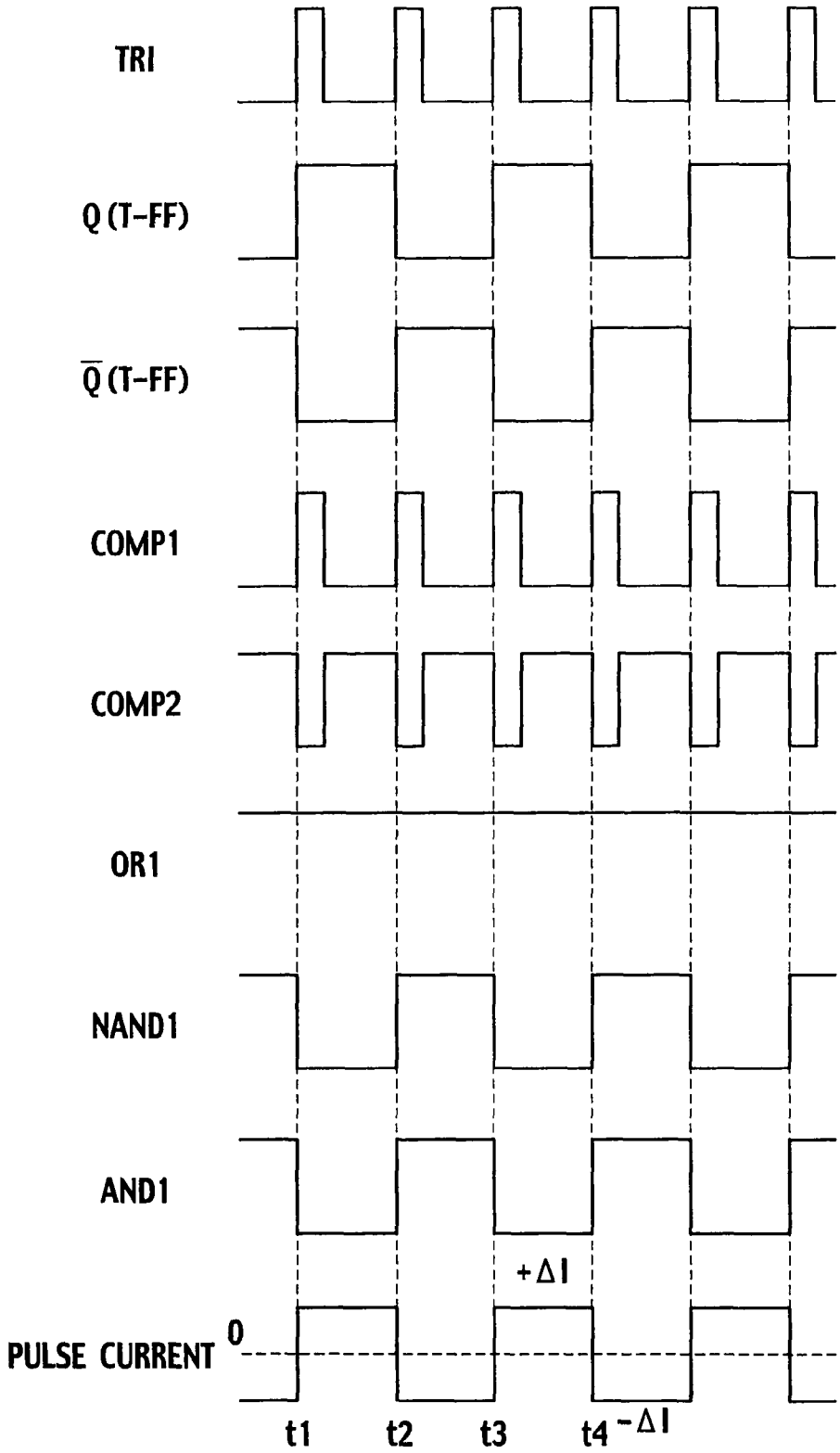
FIG. 8 is a timing chart explaining an operation of the charge/discharge pulse current generation circuit illustrated in FIG. 7.

The T-type flip-flop circuit T-FF generates, as illustrated in FIG. 8, a pulse signal Q of T-FF and an inverted pulse signal thereof that alternately repeat high and low levels at every rise edge of the synchronization pulse voltage signal TRI. The pulse signal and inverted pulse signal each are a signal having a halved frequency of the synchronization pulse voltage signal TRI, as is apparent from FIG. 8.

The comparator COMP1 provides a high-level output when the synchronization pulse voltage signal TRI is equal to or higher than the reference voltage V2. In the example illustrated in FIG. 8, the entirely same signal as the synchronization pulse voltage signal TRI is outputted to the OR gate OR1. The comparator COMP2 provides a low-level output when the synchronization pulse voltage signal TRI is equal to or higher than the reference voltage V3. In the example illustrated in FIG. 8, an inverted signal of the synchronization pulse voltage signal TRI is outputted to the OR gate OR1. Accordingly, the OR gate OR1 always provides a high-level output.

The NAND gate NAND1 operates the NAND function of the pulse signal Q of T-FF from the T-type flip-flop T-FF and the output from the OR gate OR1, and therefore, an inverted signal of the pulse signal Q of T-FF from the T-type flip-flop circuit T-FF is outputted to a gate of the p-type FET 22. As results, from time t1 to t2, the low-level output from the NAND gate NAND1 turns on the p-type FET 22 so that the p-type FET 22 passes a pulse current +ΔI by the constant current source 21*a* in a positive direction (as depicted by a right-pointing).

On the other hand, from time t2 to t3, a high-level output from the AND gate AND1 turns on the n-type FET 23 so that the n-type FET 23 passes a pulse current −ΔI in a negative direction (as depicted by a left-pointing) to the ground GND.

In this way, the charge/discharge pulse current generation circuit 20 illustrated in FIG. 7 converts, as illustrated in FIG. 8, the synchronization pulse voltage signal TRI into a pulse current that alternates between positive and negative current values ±ΔI of the same absolute value at a duty of 50% and that has a frequency formed by halving the frequency of the synchronization pulse voltage signal and superimposes the pulse current on the triangular wave signal of the oscillator 12*a*.

Figure 9:
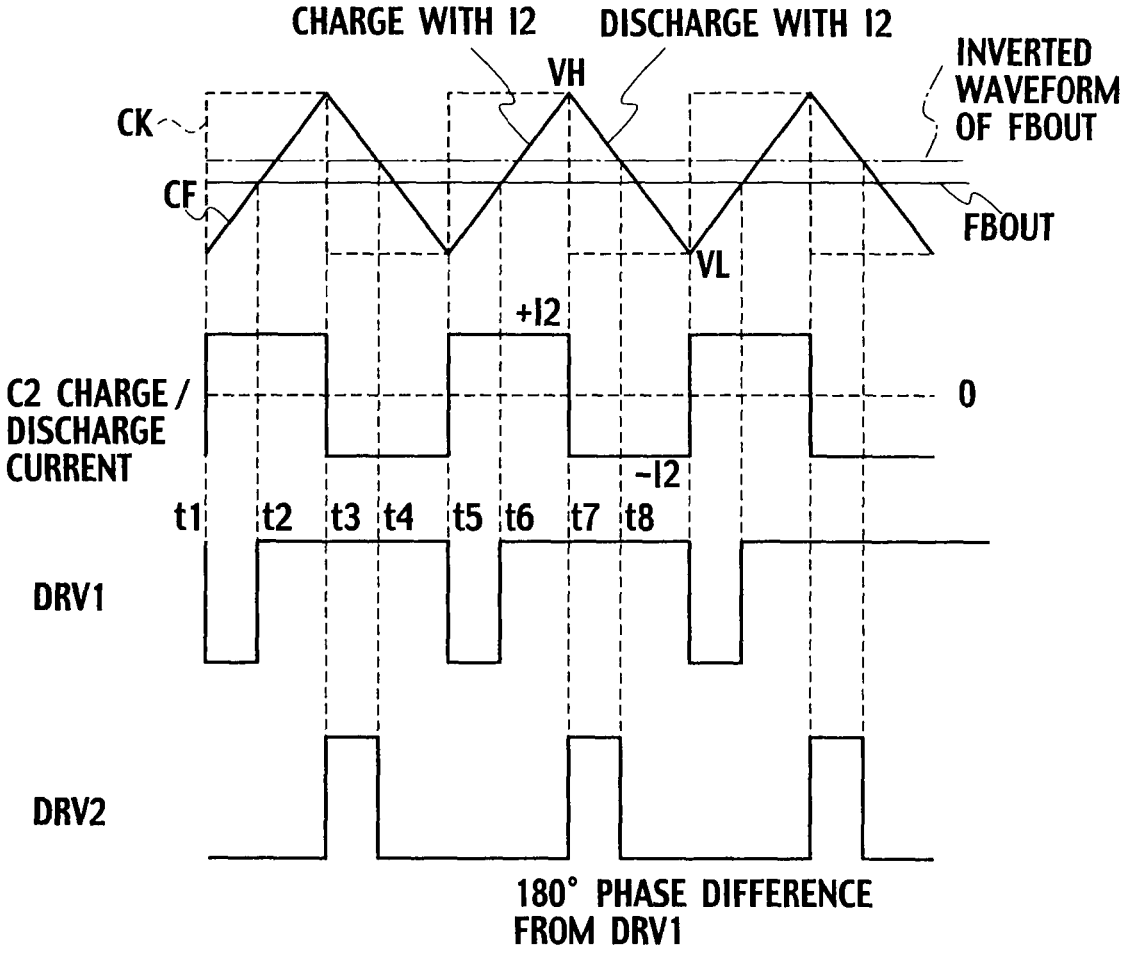
FIG. 9 is a timing chart illustrating signals at various parts of the discharge tube lighting apparatus according to Embodiment 1 of the present invention with no synchronization pulse voltage signal being inputted thereto.

A basic operation of the discharge tube lighting apparatus of FIG. 6 with no synchronization signal being input thereto will be explained with reference to the timing chart of FIG. 9.

First, a constant current I2 optionally set by the constant current determination resistor R2 makes the oscillator 12*a* charge/discharge the capacitor C2, to generate the triangular wave signal CF whose rise inclination and fall inclination are the same, and based on the triangular wave signal CF, generate the clock CK. The clock CK is a pulse signal that is synchronized with the triangular wave signal and is, for example, high level during a rise period and low level during a fall period.

Only when the clock CK from the oscillator 12*a* is high level and the signal from the PWM comparator 16*a* is high level, the NAND gate 17*c* outputs a low-level pulse signal to the p-type FET Qp1 to turn on the same. Namely, in a rise period of the triangular wave signal CF (for example, time t1 to t3, or t5 to t7 with the clock CK being high level), if the error voltage FBOUT from the error amplifier 15 is equal to or higher than the triangular wave signal CF (for example, time t1 to t2, or t5 to t6 with the signal from the PWM comparator 16*a* being high level, i.e., a period in which the triangular wave signal advances from the lower limit value VL and crosses the output from the error amplifier 15), the low-level pulse signal is outputted to the p-type FET Qp1. Namely, the pulse signal is sent to the terminal DRV1 only in a rise period of the triangular wave signal CF.

For example, from time t1 to t2, a current passes through a path extending along Vin, Qp1, C3, P, and GND, and on the secondary side of the transformer T, a current passes through a path extending along S, Lr, the discharge tube 3, and a tube current detection circuit 5.

On the other hand, the subtraction circuit 19 provides the negative terminal of the PWM comparator 16*b* with an inverted waveform of the error voltage FBOUT formed by inverting the error voltage FBOUT from the error amplifier 15 around the midpoint potential between the upper limit value and lower limit value of the triangular wave signal. Only when the inverted output of the clock CK (low level) from the oscillator 12*a* is high level and the signal from the PWM comparator 16*b* is high level, the logic gate 17*d* outputs a high-level pulse signal to the n-type FET Qn1 to turn on the same.

In a fall period of the triangular wave signal CF (for example, time t3 to t5, or t7 to t9 with the clock CK being low level), when the triangular wave signal CF is equal to or higher than the inverted waveform voltage of the error voltage FBOUT (a period in which the signal from the PWM comparator 16*b* is high level, i.e., a period in which the triangular wave signal CF advances from the upper limit value VH of the triangular wave signal CF and crosses the inverted output of the error amplifier, for example, time t3 to t4, or t7 to t8), the high-level pulse signal is outputted to the n-type FET Qn1. Namely, the pulse signal is sent to the terminal DRV2 only in a fall period of the triangular wave signal CF.

From time t3 to t4, for example, a current passes through a path extending along P, C3, Qn1, and GND, and on the secondary side of the transformer T, a current passes through a path extending along the tube current detection circuit 5, the discharge tube 3, Lr, and S.

According to the above-mentioned operation, the controller IC 1*a* uses the first drive signal and the second drive signal whose pulse width is substantially equal to that of the first drive signal and which has a phase difference of about 180 degrees with respect to the first drive signal, to alternately turn on/off the p-type FET Qp1 and n-type FET Qn1 at the frequency of the triangular wave signal CF whose rise inclination period and fall inclination period are the same, thereby supplying power to the discharge tube 3 and controlling a current passing through the discharge tube 3 at a predetermined value.

A basic operation of the discharge tube lighting apparatus of FIG. 6 with a synchronization signal being inputted thereto will be explained with reference to the timing chart of FIG. 10.

First, the constant current I2 optionally set by the constant current determination resistor R2 makes the oscillator 12*a* charge/discharge the capacitor C2, to generate the triangular wave signal CF whose rise inclination and fall inclination are the same. The charge/discharge current of the capacitor C2 alternates between positive and negative current values ±I2 of the same absolute value at a duty of 50%. The charge/discharge pulse current generation circuit 20 converts, as illustrated in FIG. 10, the synchronization pulse voltage signal TRI into a pulse current that alternates between positive and negative current values ±ΔI of the same absolute value at a duty of 50% and that has a frequency formed by halving the frequency of the synchronization pulse voltage signal and superimposes the pulse current on the triangular wave signal of the oscillator 12*a*.

Figure 10:
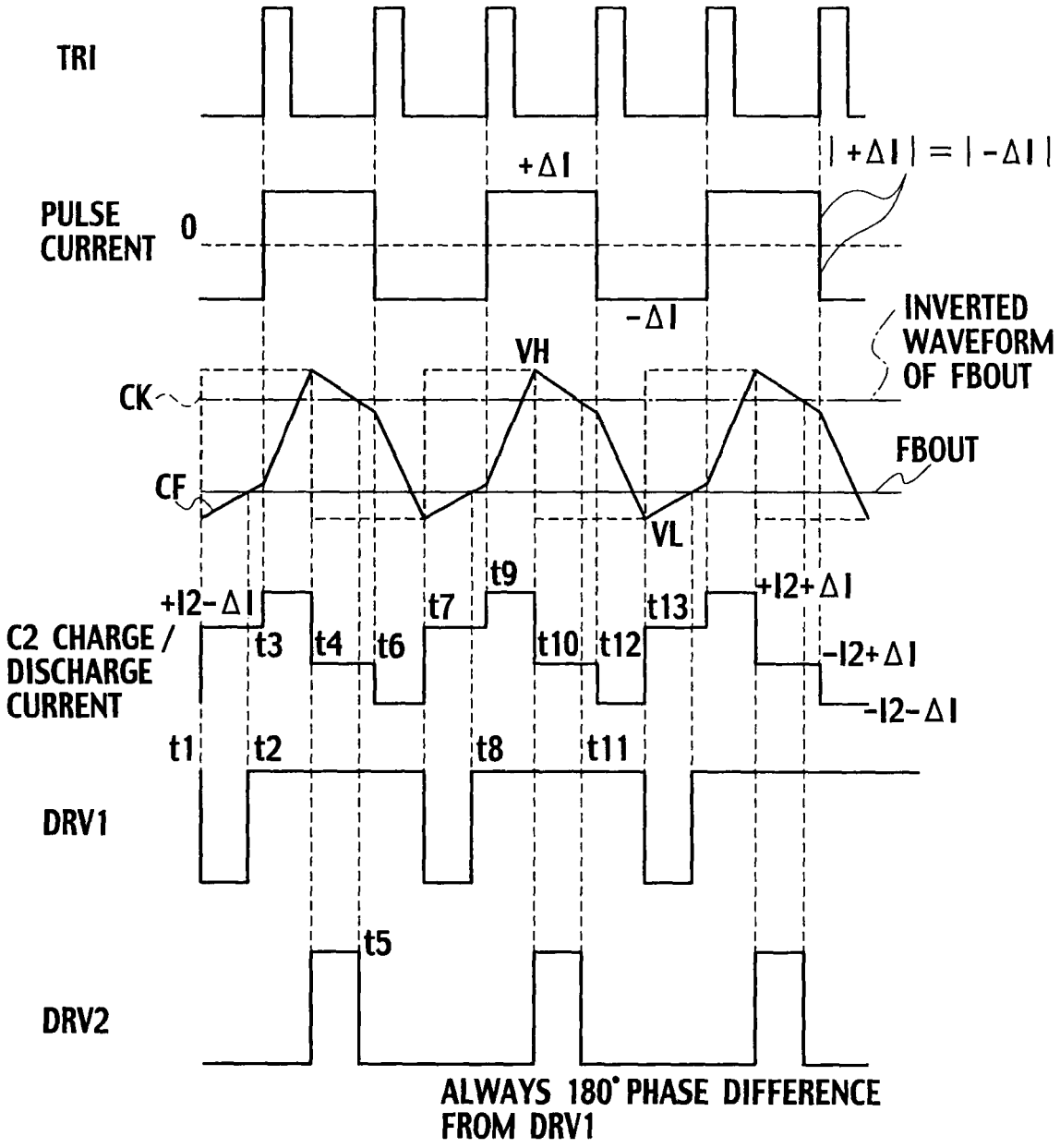
FIG. 10 is a timing chart illustrating signals at various parts of the discharge tube lighting apparatus according to Embodiment 1 of the present invention with a synchronization pulse voltage signal being inputted thereto.

According to the example illustrated in FIG. 10, the timing of the positive and negative current values ±I2 deviates from the timing of the pulse current by a duration of (t3−t1). Accordingly, the charge/discharge current of the capacitor C2 will be, as illustrated in FIG. 10, +I2−ΔI in time t1 to t3, +I2+ΔI in time t3 to t4, −I2+ΔI in time t4 to t6, and −I2−ΔI in time t6 to t7. As results, the triangular wave signal CF changes according to the charge/discharge current of the capacitor C2 and becomes a signal synchronized with the frequency of the pulse current.

A frequency band of pulse voltage signals usable for synchronization is expressed as follows in a case where, the charge/discharge current of the oscillator 12*a* determined by the current value determination resistor R2 is ±I2, an oscillation frequency determined only by the charge/discharge current ±I2 of the oscillator 12*a* is $f_F$, and a pulse current to be superimposed is ±ΔI:

$$f\max=2f_F\times(I2+\Delta I)/I2$$

$$f\min=2f_F\times(I2-\Delta I)/I2$$

If the current value of ΔI is set to be 75% of the charge/discharge current value of the oscillator 12*a*, i.e., if ΔI=0.75×I2, an oscillation frequency can be synchronized with an external synchronization pulse voltage signal of 0.5 $f_F$ to 3.5 $f_F$. On the contrary, if the oscillation frequency $f_F$ is set around 50 kHz, it can be synchronized with a synchronization pulse voltage signal of 25 kHz to 175 kHz. According to the example of FIG. 6, the current value ΔI of the pulse current is fixed. The current value ΔI may be determined by R2, to always keep the same ratio with respect to I2. To independently adjust the current value ΔI, the semiconductor integrated circuit 1*a* may have a terminal to independently determine ΔI.

In this way, according to the discharge tube lighting apparatus of Embodiment 1, the charge/discharge pulse current generation circuit 20 converts a synchronization pulse voltage signal into a pulse current that alternates between positive and negative current values of the same absolute value at a duty of 50% and that has a frequency formed by halving the frequency of the synchronization pulse voltage signal and superimposes the pulse current on a triangular wave signal. The signal generation part generates first and second drive signals in synchronization with the halved frequency of the pulse current. Namely, an oscillation frequency is synchronized with the frequency formed by halving the frequency of the synchronization pulse voltage signal and a lighting frequency of the discharge tube is synchronized with the frequency formed by halving the frequency of the synchronization pulse voltage signal. The synchronization is achievable without regard to whether the frequency of the synchronization pulse voltage signal is higher or lower than the oscillation frequency of the oscillator 12*a*. A frequency band of pulse voltage signals usable for synchronization can be expanded and an oscillation frequency can stably and easily be synchronized with the synchronization pulse voltage signal.

Embodiment 2

Figure 11:
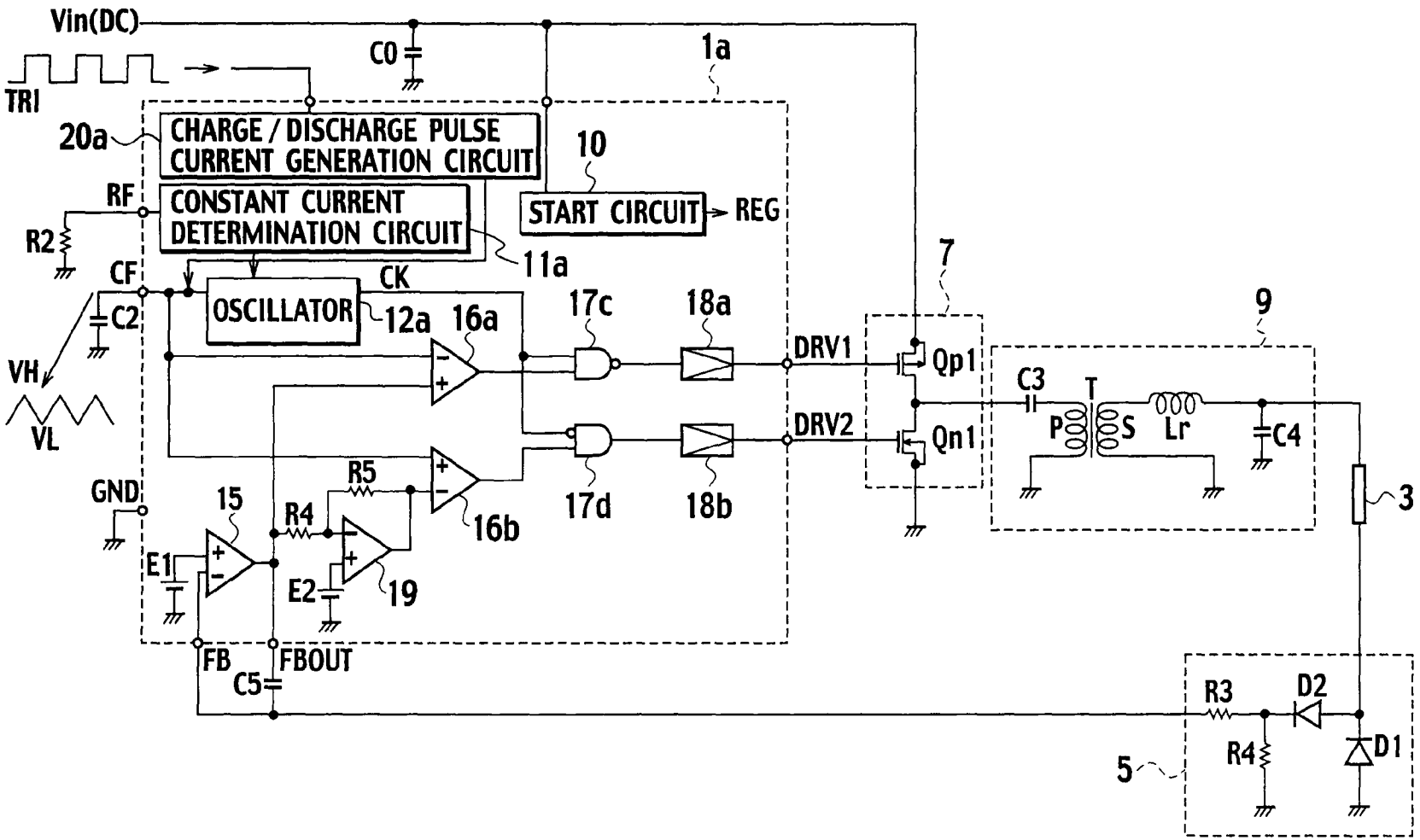
FIG. 11 is a circuit diagram illustrating a configuration of a discharge tube lighting apparatus according to Embodiment 2 of the present invention.
Figure 12:
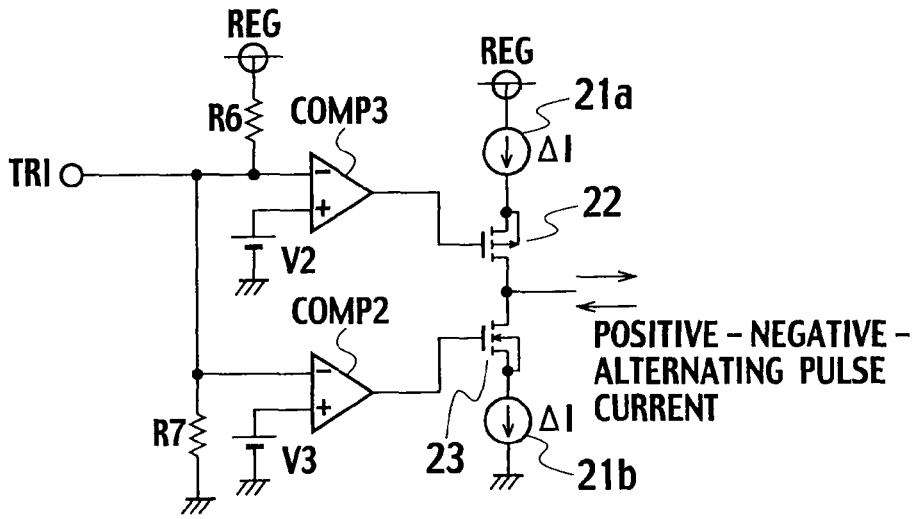
FIG. 12 is a circuit diagram illustrating a configuration of a charge/discharge pulse current generation circuit arranged in the discharge tube lighting apparatus according to Embodiment 2 of the present invention.

FIG. 11 is a circuit diagram illustrating a configuration of a discharge tube lighting apparatus according to Embodiment 2 of the present invention. FIG. 12 is a circuit diagram illustrating a configuration of a charge/discharge pulse current generation circuit arranged in the discharge tube lighting apparatus according to Embodiment 2 of the present invention. According to Embodiment 2, the charge/discharge pulse current generation circuit 20*a* converts a synchronization pulse voltage signal TRI of 50% in duty from a microcomputer into a pulse current of the same duty of 50% having positive and negative current values of the same absolute value. The pulse current is superimposed on a charge/discharge current of an oscillator 12*a*. In synchronization with a frequency of the pulse current from the charge/discharge pulse current generation circuit 20*a*, a signal generation part generates first and second drive signals. Namely, an oscillation frequency is synchronized with the frequency of the synchronization pulse voltage signal and a lighting frequency of a discharge tube 3 is synchronized with the frequency of the synchronization pulse voltage signal.

FIG. 12 is a circuit diagram illustrating a configuration of the charge/discharge pulse current generation circuit arranged in the discharge tube lighting apparatus according to Embodiment 2 of the present invention. Compared with the charge/discharge pulse current generation circuit 20 illustrated in FIG. 7, the charge/discharge pulse current generation circuit 20*a* excludes the T-type flip-flop circuit T-FF, OR gate OR1, NAND gate NAND1, and AND gate AND1, changes the comparator COMP1 to a comparator COMP3, connects an output of the comparator COMP3 to a gate of a p-type FET 22, and connects an output of a comparator COMP2 to a gate of an n-type FET 23. Compared with the comparator COMP1, the comparator COMP3 has opposite configuration to positive and negative terminals.

The remaining arrangement of FIG. 12 is the same as that of FIG. 7, and therefore, the same parts are represented with like reference marks to omit their explanations.

The comparator COMP3 provides a low-level output when the synchronization pulse voltage signal TRI is equal to or higher than a reference voltage V2. In the example illustrated in FIG. 13, an inverted signal of the synchronization pulse voltage signal TRI is outputted to the p-type FET 22. Accordingly, in time duration of t1 to t2, the p-type FET 22 turns on to pass a pulse current +ΔI by a constant current source 22*a* in a positive direction (as depicted by a right-pointing).

The comparator COMP2 provides a high-level output when the synchronization pulse voltage signal TRI is lower than a reference voltage V3. In the example illustrated in FIG. 13, an inverted signal of the synchronization pulse voltage signal TRI is outputted to the n-type FET 23. As a result, in time duration of t2 to t3, the n-type FET 23 turns on to pass a pulse current −ΔI to the ground GND in a negative direction (as depicted by a left-pointing).

Figure 13:
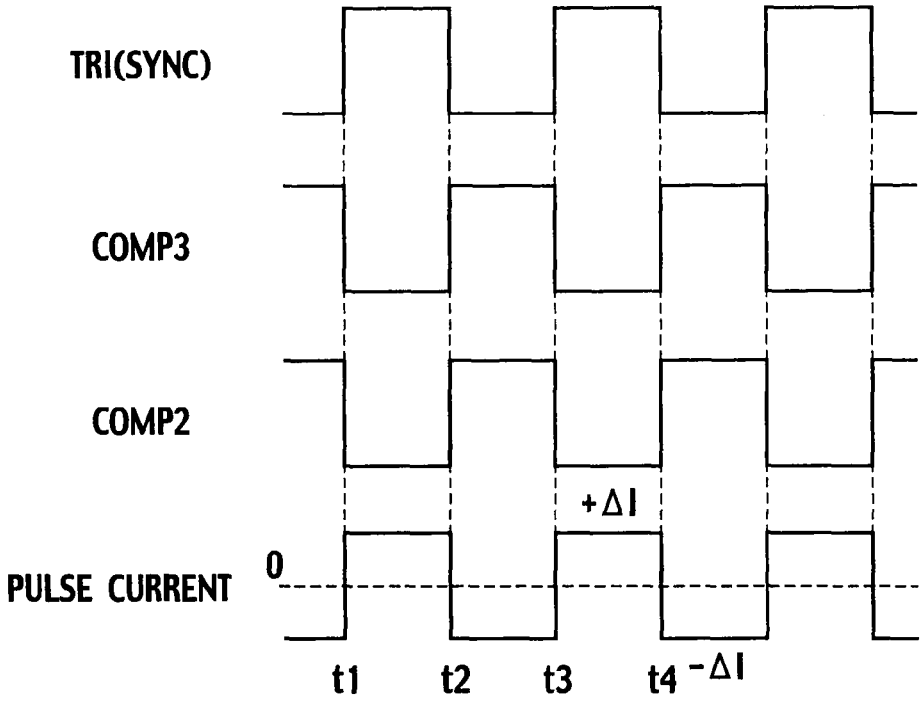
FIG. 13 is a timing chart explaining an operation of the charge/discharge pulse current generation circuit illustrated in FIG. 12.

In this way, the charge/discharge pulse current generation circuit 20*a* illustrated in FIG. 12 converts, as illustrated in FIG. 13, the synchronization pulse voltage signal TRI of 50% in duty into a pulse current of 50% in duty having positive and negative current values ΔI of the same absolute value and superimposes the pulse current on the triangular wave signal of the oscillator 12*a*.

A frequency band of pulse voltage signals usable for synchronization is expressed as follows in a case where the charge/discharge current of the oscillator 12*a* determined by a current value determination resistor R2 is ±I2, an oscillation frequency determined only by the charge/discharge current ±I2 of the oscillator 12*a* is $f_F$, and a pulse current to be superimposed is ±ΔI:

$$f\max=f_F\times(I2+\Delta I)/I2$$

$$f\min=f_F\times(I2-\Delta I)/I2$$

If the current value of ΔI is set to be 75% of the charge/discharge current value of the oscillator 12*a*, i.e., if ΔI is equal to 0.75×I2, an oscillation frequency can be synchronized with an external synchronization pulse voltage signal of 0.25 $f_F$ to 1.75 $f_F$. Namely, if the oscillation frequency $f_F$ is set around 50 kHz, it can be synchronized with a synchronization pulse voltage signal of 12.5 kHz to 87.5 kHz. Accordingly, by presetting $f_F$ around the frequency of a pulse current that is to be superimposed on the charge/discharge current of the oscillator 12*a* and corresponds to an external synchronization pulse voltage signal, a frequency band of pulse voltage signals usable for synchronization can be widened both in higher and lower directions.

Figure 14:
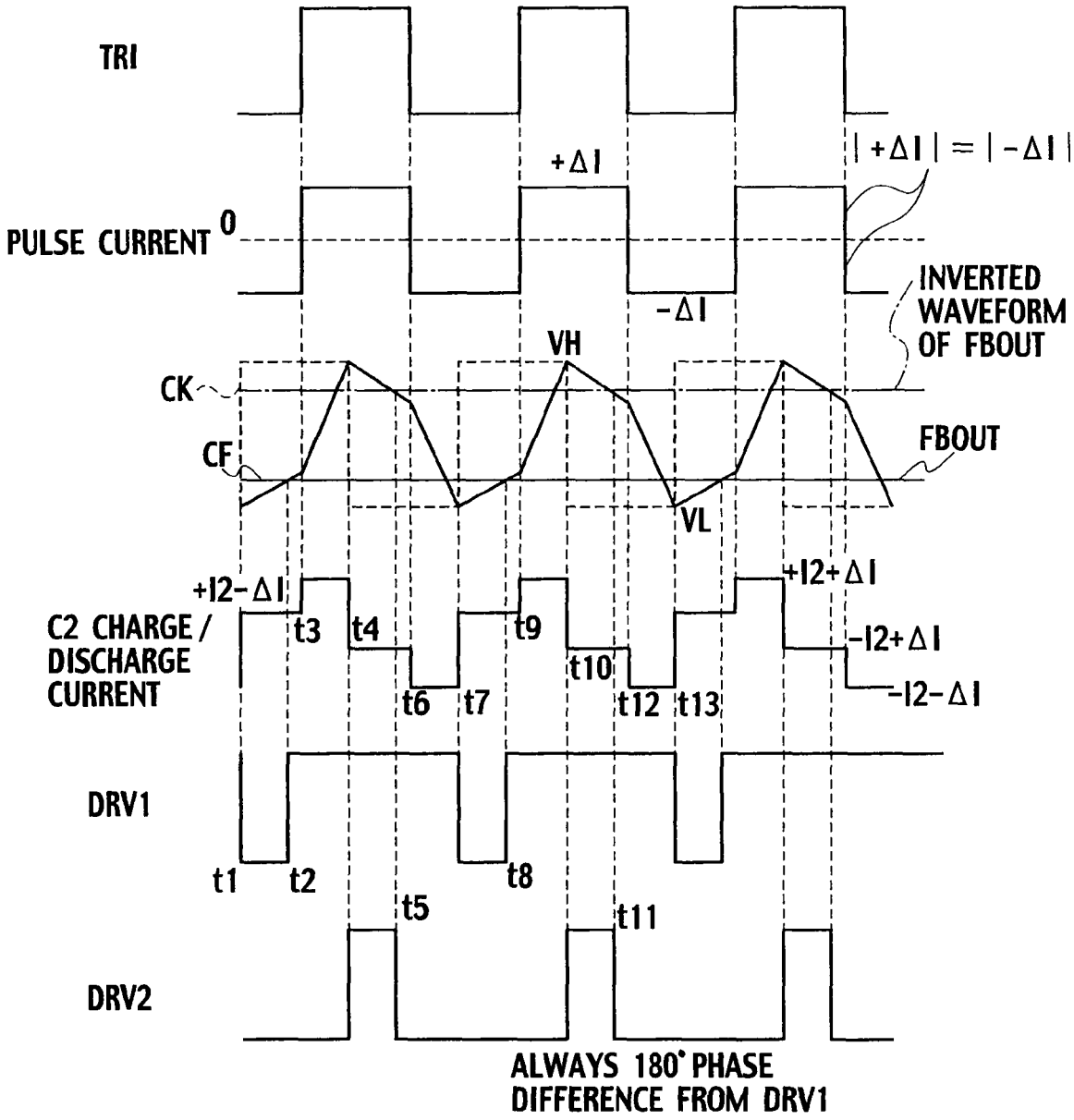
FIG. 14 is a timing chart illustrating signals at various parts of the discharge tube lighting apparatus according to Embodiment 2 of the present invention with a synchronization pulse voltage signal being input thereto.

FIG. 14 is a timing chart illustrating signals at various parts of the discharge tube lighting apparatus according to the present embodiment of the present invention with a synchronization pulse voltage signal being inputted thereto. Operation thereof is the same as that of the timing chart illustrated in FIG. 10 of Embodiment 1, and therefore, the explanation thereof is omitted.

Embodiment 3

Figure 15:
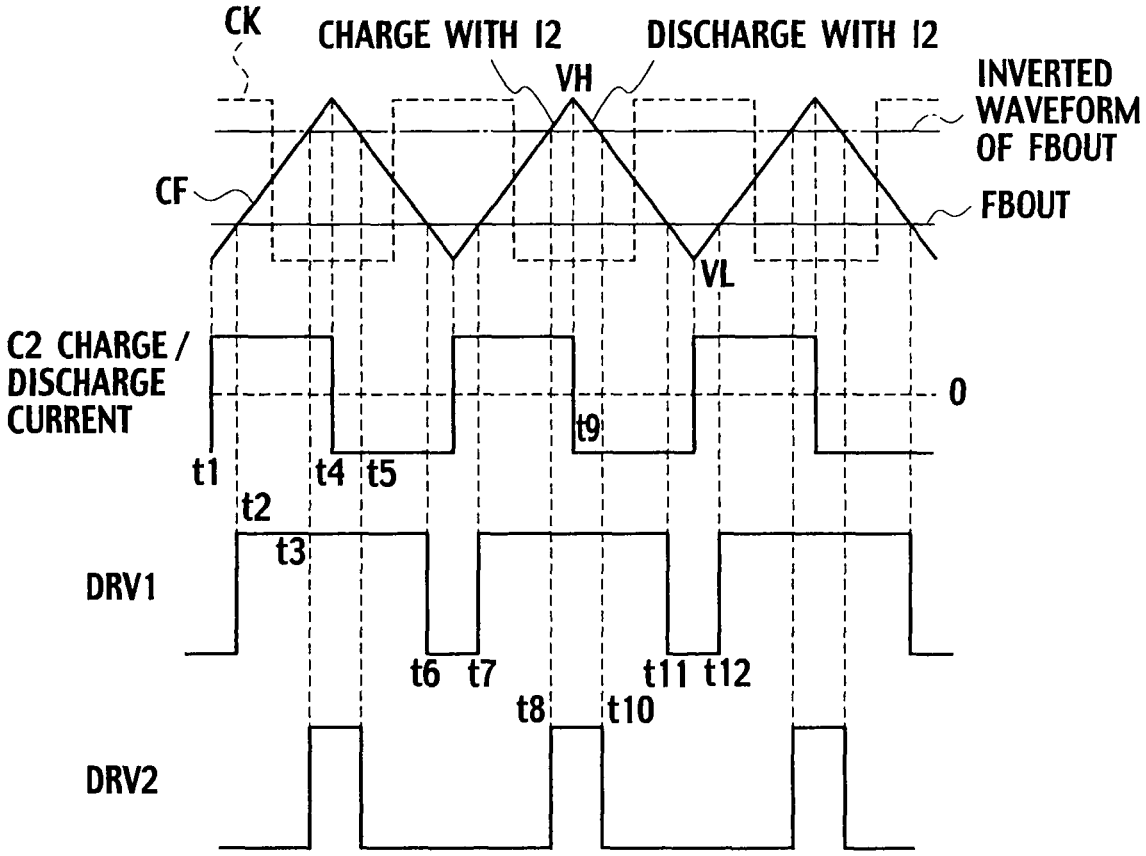
FIG. 15 is a timing chart illustrating signals at various parts of a discharge tube lighting apparatus according to Embodiment 3 of the present invention with no synchronization pulse voltage signal being inputted thereto.
Figure 16:
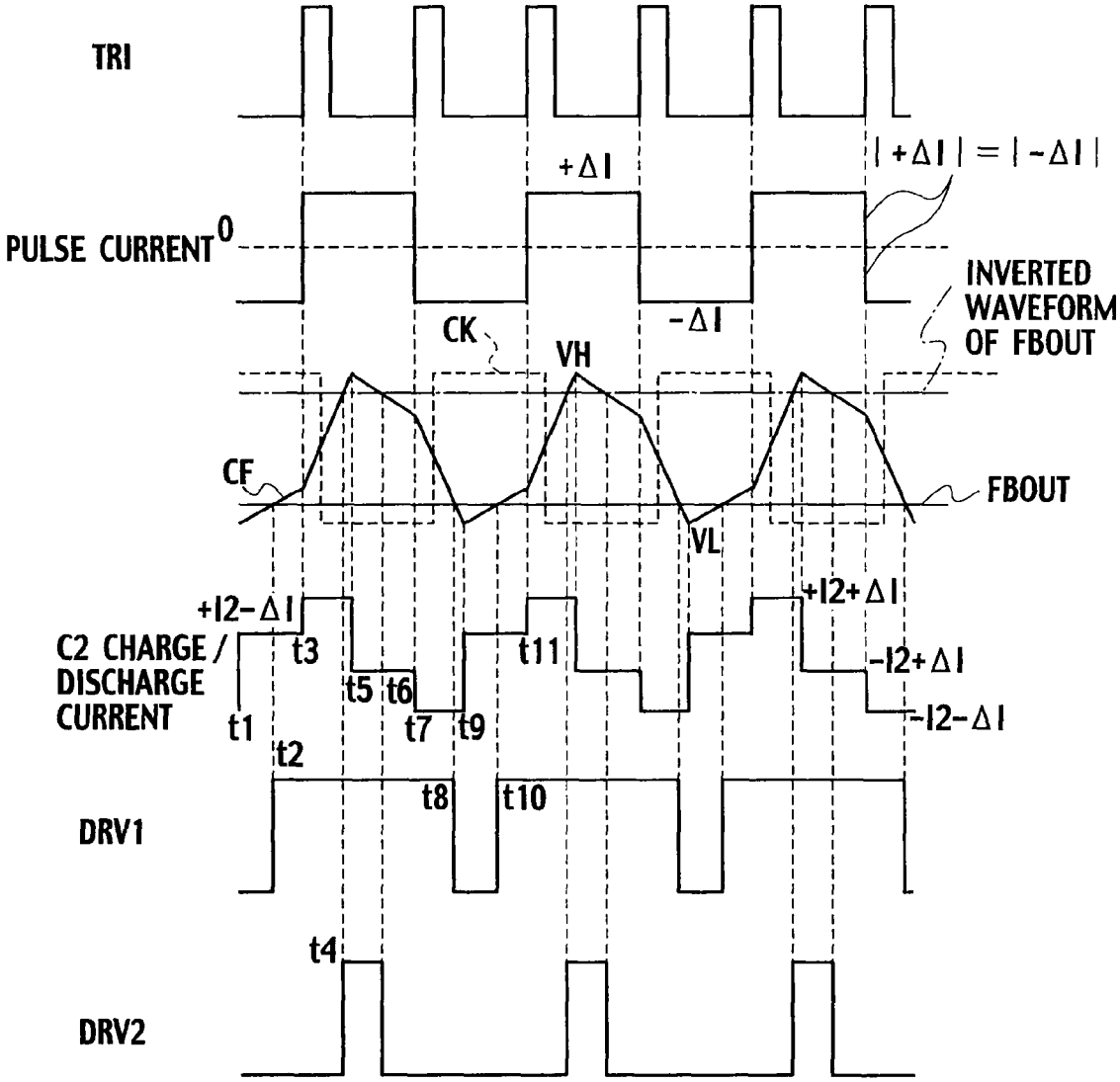
FIG. 16 is a timing chart illustrating signals at various parts of the discharge tube lighting apparatus according to Embodiment 3 of the present invention with a synchronization pulse voltage signal being inputted thereto.

FIG. 15 is a timing chart illustrating signals at various parts of a discharge tube lighting apparatus according to Embodiment 3 of the present invention with no synchronization pulse voltage signal being input thereto. FIG. 16 is a timing chart illustrating signals at various parts of the discharge tube lighting apparatus according to Embodiment 3 of the present invention with a synchronization pulse voltage signal being input thereto. A basic circuit configuration thereof is the same as that of the discharge tube lighting apparatus illustrated in FIG. 6 and it differs therefrom in that the timing of a clock CK from an oscillator 12*a* relative to a triangular wave signal CF differs from that illustrated in FIG. 9.

According to the present embodiment as illustrated in FIG. 15, the clock CK has a pulse voltage waveform that is synchronized with the triangular wave signal CF and is high level in a period in which the triangular wave signal CF is lower than a midpoint potential between an upper limit value VH and a lower limit value VL and low level in a period in which the triangular wave signal CF is higher than the midpoint potential.

A NAND gate 17*c* outputs, only when the clock CK from the oscillator 12*a* is high level and a signal from a PWM comparator 16*a* is high level, a low-level pulse signal to a p-type FET Qp1 to turn on the same. Namely, in a period in which the triangular wave signal CF is lower than the midpoint potential between the upper limit value and the lower limit value (a period in which the clock CK is high level) and an error voltage FBOUT from an error amplifier 15 is equal to or higher than the triangular wave signal CF (the signal from the PWM comparator 16*a* being high level, for example, time duration of t6 to t7, or t11 to t12), the low-level pulse signal is outputted to the p-type FET Qp1. Namely, the pulse signal is sent to a terminal DRV1 only in the period in which the triangular wave signal CF is lower than the midpoint potential between the upper limit value and the lower limit value.

On the other hand, a subtraction circuit 19 provides a negative terminal (as depicted by "−") of a PWM comparator 16*b* with an inverted waveform of the error voltage FBOUT formed by inverting the error voltage FBOUT from the error amplifier 15 around the midpoint potential between the upper limit value and lower limit value of the triangular wave signal. A logic gate 17*d* outputs, only when an inverted output of the clock CK (low level) from the oscillator 12 is high level and the signal from the PWM comparator 16*b* is high level, a high-level pulse signal to an n-type FET Qn1 to turn on the same.

In a period in which the triangular wave signal CF is higher than the midpoint potential between the upper limit value and the lower limit value (a period in which the clock CK is low level) and the triangular wave signal CF is equal to or higher than the inverted waveform formed by inverting the error voltage FBOUT from the error amplifier 15 (for example, time duration of t3 to t5, or t8 to t10 in which the signal from the PWM comparator 16*a* is low level), the high-level pulse signal is outputted to the n-type FET Qn1. Namely, the pulse signal is sent to a terminal DRV2 only in a period in which the triangular wave signal CF is higher than the midpoint potential between the upper limit value and the lower limit value.

In this way, control conducted by the discharge tube lighting apparatus of the present embodiment can also control a current passing through the discharge tube 3 at a predetermined value.

Operation of the timing chart illustrated in FIG. 16 is similar to that of the timing chart illustrated in FIG. 10. A charge/discharge current of a capacitor C2 is the same as that illustrated in FIG. 10. The triangular wave signal CF changes according to the charge/discharge current of the capacitor C2 and becomes a signal synchronized with the frequency of the pulse current. It is possible, therefore, to synchronize an oscillation frequency with a halved frequency of a synchronization pulse voltage signal.

Embodiment 4

Figure 17:
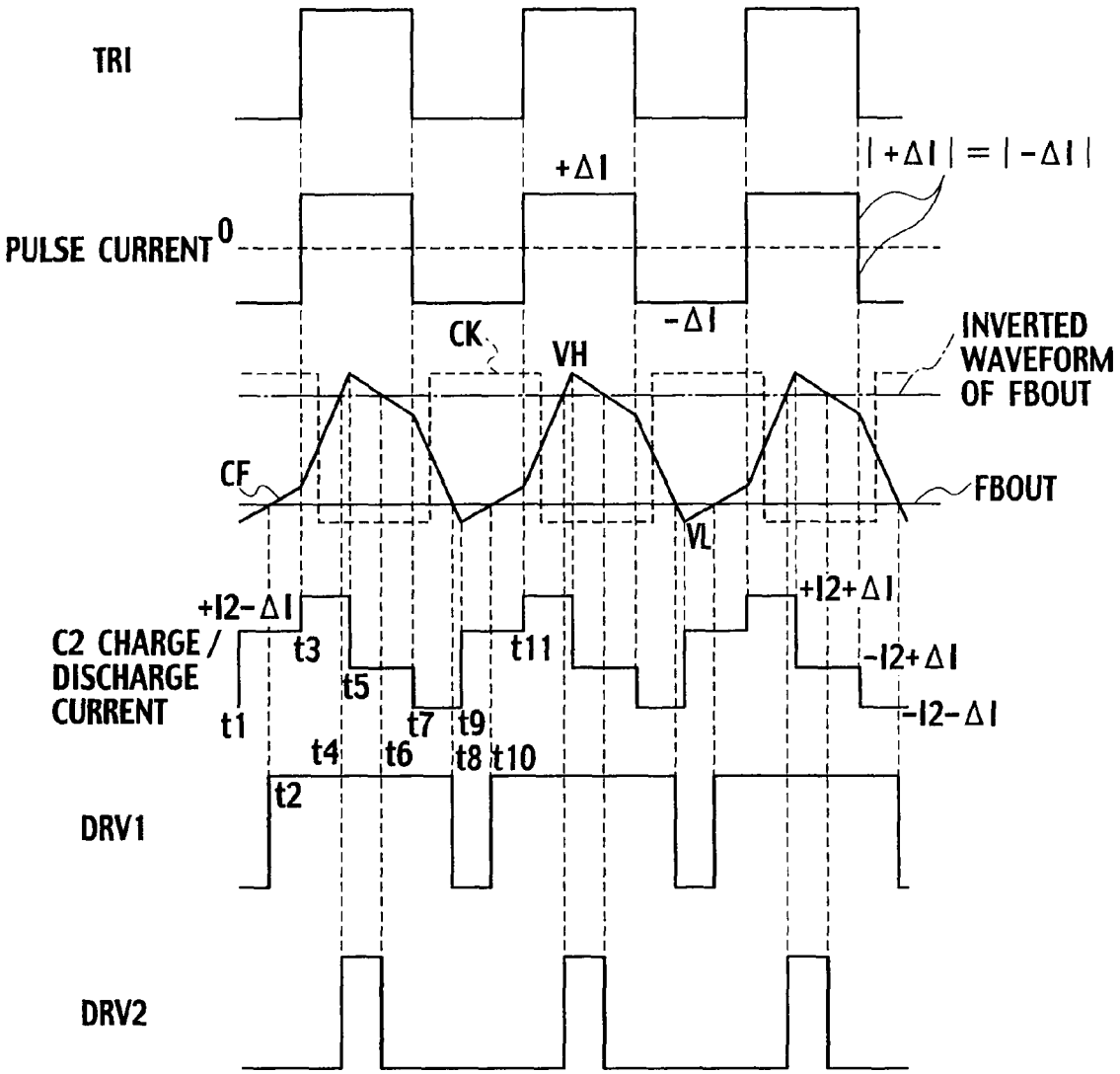
FIG. 17 is a timing chart illustrating signals at various parts of a discharge tube lighting apparatus according to Embodiment 4 of the present invention with a synchronization pulse voltage signal being inputted thereto.

FIG. 17 is a timing chart illustrating signals at various parts of a discharge tube lighting apparatus according to Embodiment 4 of the present invention with a synchronization pulse voltage signal being input thereto. Operation waveforms when no synchronization signal is inputted are completely the same as those illustrated in FIG. 15. A basic circuit configuration thereof is the same as that of the discharge tube lighting apparatus illustrated in FIG. 11 and it differs therefrom in that the timing of a clock CK from an oscillator 12*a* relative to a triangular signal CF differs from that illustrated in FIG. 14.

Control conducted by the discharge tube lighting apparatus of the present embodiment can also control a current passing through a discharge tube 3 at a predetermined value. It is possible to synchronize an oscillation frequency with the frequency of a synchronization pulse voltage signal of 50% in duty.

Embodiment 5

Figure 18:
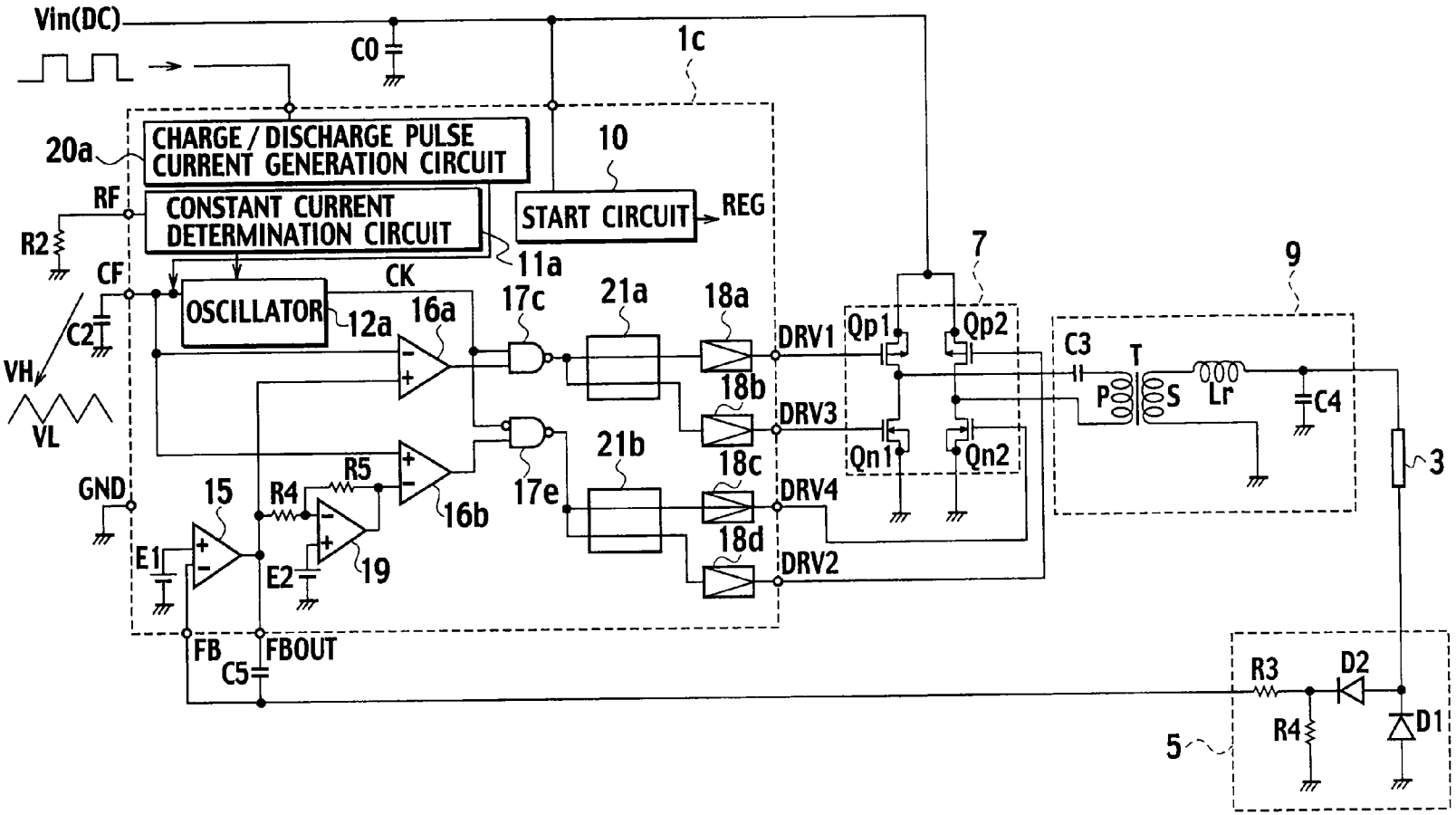
FIG. 18 is a circuit diagram illustrating a configuration of a discharge tube lighting apparatus according to Embodiment 5 of the present invention.

FIG. 18 is a circuit diagram illustrating a configuration of a discharge tube lighting apparatus according to Embodiment 5 of the present invention. The discharge tube lighting apparatus illustrated in FIG. 18 is an example of a discharge tube lighting apparatus with a full-bridge circuit and is different from Embodiment 1 illustrated in FIG. 6 in that a controller IC 1*c* employs a p-type FET Qp2, an n-type FET Qn2, a logic gate 17*e*, dead time creation circuits 21*a* and 21*b*, and drivers 18*a* to 18*d*.

Between a DC power source Vin and the ground, there is connected a series circuit having the high-side p-type FET Qp2 and low-side n-type FET Qn2. Between a connection point of a p-type FET Qp1 and an n-type FET Qn1 and a connection point of the p-type FETQp2 and n-type FET Qn2, there is connected a series circuit having a resonant capacitor C3 and a primary winding P of a transformer T. A terminal DRV1 is connected to a gate of the p-type FET Qp1, a terminal DRV3 is connected to a gate of the n-type FET Qn1, a terminal DRV2 is connected to a gate of the p-type FET Qp2, and a terminal DRV4 is connected to a gate of the n-type FET Qn2.

The logic gate 17*e* operates the NAND function of an inversion of a clock CK from an oscillator 12*a* and a signal from a PWM comparator 16*b*. The dead time creation circuit 21*a* creates, based on a signal from a NAND gate 17*c*, a third drive signal DRV3 having a predetermined dead time DT relative to a first drive signal DRV1 to the driver 18*a* and outputs the signal to the driver 18*b*. The dead time creation circuit 21*b* creates, based on the signal from the logic gate 17*e*, a second drive signal DRV2 having the predetermined dead time DT relative to a fourth drive signal DRV4 to the driver 18*c* and outputs the second drive signal to the driver 18*d*.

The first and third drive signals and the second and fourth drive signals have the dead time DT to prevent simultaneous ON operation. Except the dead time DT, the third drive signal is substantially the same as the first drive signal and the fourth drive signal as the second drive signal. A charge/discharge pulse current generation circuit 20*a* has the same configuration as the circuit illustrated in FIG. 12.

According to this configuration, when a triangular wave signal CF is in a rise period and an error voltage FBOUT from an error amplifier 15 is equal to or higher than the triangular wave signal CF, a low-level pulse signal is outputted through the dead time creation circuit 21*a* and drivers 18*a* and 18*b* to the p-type FET Qp1 and n-type FET Qn1, to turn on the p-type FET Qp1. When the triangular wave signal CF is in the rise period, a high-level pulse signal is outputted through the dead time creation circuit 21*b* and drivers 18*c* and 18*d* to the p-type FET Qp2 and n-type FET Qn2, to turn on the n-type FET Qn2. During this period, a current passes through a path extending along Vin, Qp1, C3, P, Qn2, and GND, and on the secondary side of a transformer T, a current passes through a path extending along S, Lr, a discharge tube 3, and a tube current detection circuit 5.

On the other hand, when the triangular wave signal CF is in a fall period, a high-level pulse signal is output through the dead time creation circuit 21*a* and drivers 18*a* and 18*b* to the p-type FET Qp1 and n-type FET Qn1, to turn on the n-type FET Qn1. Also when the triangular wave signal CF is in the fall period and the error voltage FBOUT is equal to or higher than an inverted voltage C2' from the subtraction circuit 19, a high-level pulse signal is outputted to the logic gate 17*e*, which provides a low-level output through the dead time creation circuit 21*b* and drivers 18*c* and 18*d* to the p-type FET Qp2 and n-type FET Qn2, to turn on the p-type FET Qp2.

During this period, a current passes through a path extending along Vin, Qp2, P, C3, Qn1, and GND, and on the secondary side of the transformer T, a current passes through a path extending along the tube current detection circuit 5, the discharge tube 3, Lr, and S.

Figure 19:
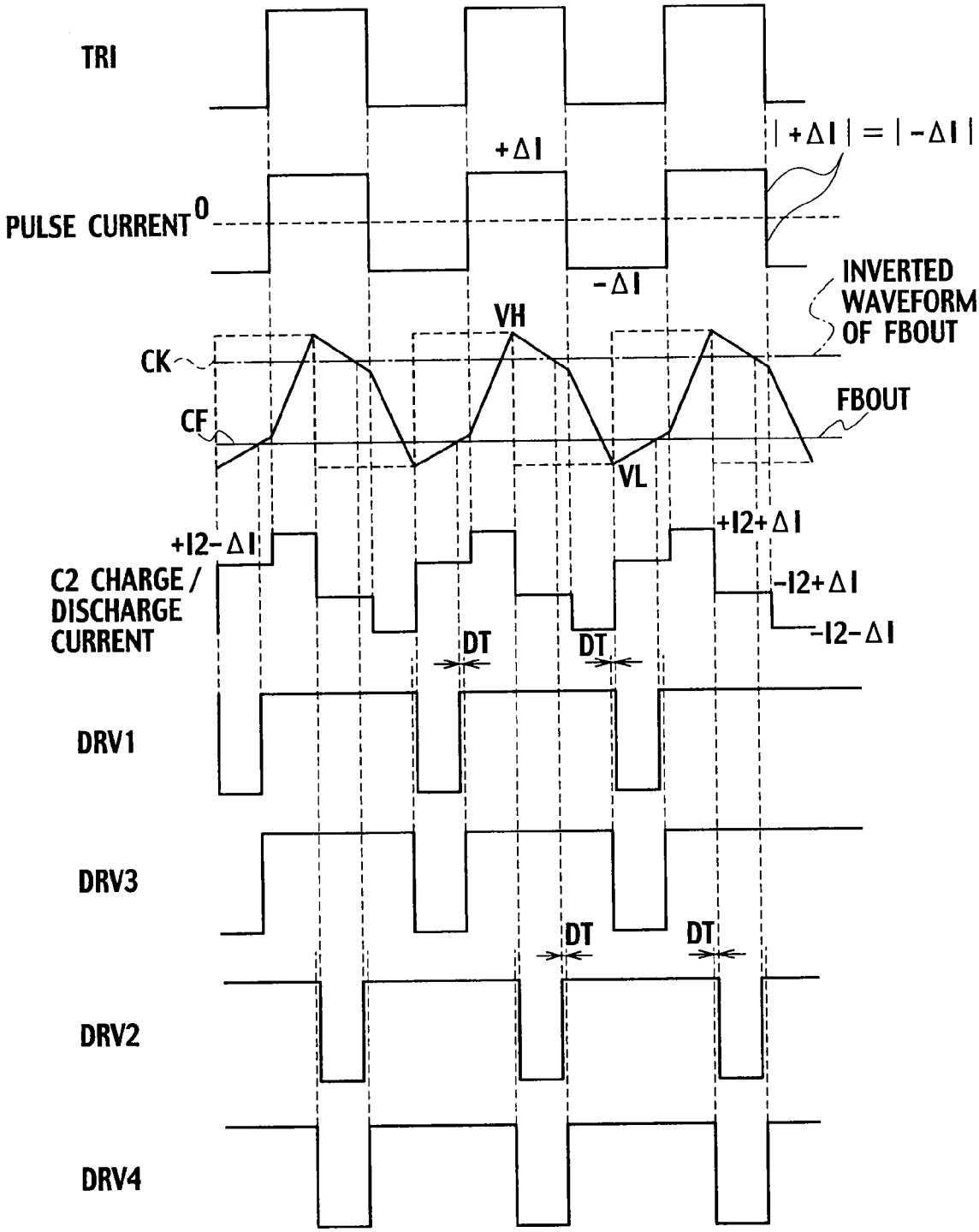
FIG. 19 is a timing chart illustrating signals at various parts of the discharge tube lighting apparatus according to Embodiment 5 of the present invention with a synchronization pulse voltage signal being inputted thereto.

FIG. 19 is a timing chart illustrating signals at various parts of the discharge tube lighting apparatus according to the present embodiment of the present invention with a synchronization pulse voltage signal being inputted thereto. Operation thereof is the same as the operation of the timing chart illustrated in FIG. 14 of Embodiment 2 except the dead time DT of the first to fourth drive signals, and therefore, the explanation thereof is omitted. In this way, the discharge tube lighting apparatus of the present embodiment employing the full-bridge circuit can provide an effect similar to that provided by the discharge tube lighting apparatus of Embodiment 1.

The discharge tube lighting apparatuses according to the present invention are not limited to those of the above-mentioned embodiments. According to Embodiments 1 to 5, the second drive signal has an exact phase difference of 180 degrees with respect to the first drive signal. Within a range not to largely deteriorate the symmetry of a current passed to the discharge tube 3, the phase difference may deviate from the exact 180 degrees, i.e., it may involve a slight error to make it, for example, 179 degrees, 181 degrees, or the like.

According to each embodiment of the present invention, the pulse current is a perfect rectangular wave. It may be an imperfect rectangular waveform if it alternates between positive and negative values at a duty of 50% and has positive and negative waveforms that are identical to each other with a phase difference of 180 degrees. For example, a pulse voltage that alternates between positive and negative values at a duty of 50% with the absolute values of the positive and negative values being equal to each other with respect to a midpoint potential of a triangular wave signal may be connected through a resistor to a capacitor C2, so that a pulse-like current that alternates between positive and negative values of the same absolute value at a duty of 50% is superimposed on a charge-discharge current of the oscillator 12*a*.

Within a range in which the symmetry of a current passed to a discharge tube is not largely broken, the duty of the pulse current may not exactly be 50%. Also, the absolute values of the positive and negative values of the pulse current may involve a slight error.

Effect of Invention

The present invention can synchronize an oscillation frequency of an oscillator with a synchronization pulse voltage signal even if the frequency of the synchronization pulse voltage signal is higher or lower than the oscillation frequency, expand a frequency band of pulse voltage signals usable for synchronization, and stably and easily synchronize the oscillation frequency with the synchronization pulse voltage signal.

INDUSTRIAL APPLICABILITY

The present invention is applicable to frequency synchronizing methods for discharge tube lighting apparatuses, discharge tube lighting apparatuses, and semiconductor integrated circuits.

(United States Designation)

This application claims benefit of priority under 35 USC §119 to Japanese Patent Application No. 2006-274214, filed on Oct. 5, 2006, the entire content of which is incorporated by reference herein.

The invention claimed is:

1. A frequency synchronizing method for a discharge tube lighting apparatus having a resonant circuit including a capacitor connected to at least one of primary and secondary windings of a transformer, an output of the resonant circuit being connected to a discharge tube, and a plurality of switching elements of bridge configuration connected to both ends of a DC power source, to pass a current through the primary winding of the transformer and the capacitor, comprising:

generating a triangular wave signal whose inclination for charging an oscillator capacitor and inclination for discharging the same are the same and which is used to turn on/off the plurality of switching elements;

generating a first drive signal in a period shorter than a half period of the triangular wave signal, the first drive signal having a pulse width corresponding to a current passing through the discharge tube, and configured to drive a first group of one or more switching elements among the plurality of switching elements and provide a current to the discharge tube;

generating a second drive signal having a pulse width substantially equal to that of the first drive signal and a phase difference of about 180 degrees with respect to the first drive signal, configured to drive a second group of one or more switching elements among the plurality of switching elements and provide a current to the discharge tube in a direction opposite to the current driven by the first drive signal; and converting a synchronization pulse voltage signal into a pulse current that alternates between positive and negative current values of the same absolute value at a duty of about 50% and superimposing the pulse current on the triangular wave signal of the oscillator for generating a modulated pulse current, wherein the first and second drive signals are generated in synchronization with the frequency of the modulated pulse current.

2. The frequency synchronizing method for a discharge tube lighting apparatus as set forth in claim 1, wherein the frequency of the pulse current is a predetermined integer multiple of the frequency of the synchronization pulse voltage signal.

3. The frequency synchronizing method for a discharge tube lighting apparatus as set forth in claim 1, wherein the oscillation frequency of the triangular wave signal when the pulse current is not superimposed is set around the frequency of the pulse current.

4. A discharge tube lighting apparatus that converts a direct current into a positive-negative symmetrical alternating current and supplies power to a discharge tube, comprising:

a resonant circuit including a capacitor connected to at least one of primary and secondary windings of a transformer, an output of the resonant circuit being connected to the discharge tube;

a plurality of switching elements of bridge configuration connected to both ends of a DC power source, configured to pass a current through the primary winding of the transformer and the capacitor;

an oscillator that generates a triangular wave signal whose inclination for charging an oscillator capacitor and inclination for discharging the same are the same and which is used to turn on/off the plurality of switching elements;

a signal generation part that generates a first drive signal in a period shorter than a half period of the triangular wave signal, the first drive signal having a pulse width corresponding to a current passing through the discharge tube for driving a first group of one or more switching elements among the plurality of switching elements and providing a current to the discharge tube, as well as generating a second drive signal having a pulse width substantially equal to that of the first drive signal and a phase difference of about 180 degrees with respect to the first drive signal for driving a second group of one or more switching elements among the plurality of switching elements and providing a current to the discharge tube in a direction opposite to the current driven by the first drive signal; and a pulse current generation circuit configured to convert a synchronization pulse voltage signal into a pulse current that alternates between positive and negative current values of the same absolute value at a duty of about 50% and superimpose the pulse current on the triangular wave signal of the oscillator, wherein the signal generation part that generates the first drive signal and second drive signal in synchronization with the frequency of the pulse current from the pulse current generation circuit.

5. The discharge tube lighting apparatus as set forth in claim 4, wherein the frequency of the pulse current is a predetermined integer multiple of the frequency of the synchronization pulse voltage signal.

6. The discharge tube lighting apparatus as set forth in claim 4, wherein the half period of the triangular wave signal is a rise inclination period or fall inclination period of the triangular wave signal.

7. The discharge tube lighting apparatus as set forth in claim 4, wherein the half period of the triangular waveform is a period equal to or above a midpoint potential between an upper limit value and a lower limit value of the triangular wave signal, or a period below the midpoint potential.

8. A semiconductor integrated circuit that controls a plurality of switching elements of bridge configuration to supply power to a discharge tube, comprising:

an oscillator that generates a triangular wave signal whose inclination for charging an oscillator capacitor and inclination for discharging the same are the same and which is used to turn on/off the plurality of switching elements;

a signal generation part that generates a first drive signal in a period shorter than a half period of the triangular wave signal, the first drive signal having a pulse width corresponding to a current passing through the discharge tube configured to drive a first group of one or more switching elements among the plurality of switching elements for providing a current to the discharge tube, as well as generating a second drive signal having a pulse width substantially equal to that of the first drive signal and a phase difference of about 180 degrees with respect to the first drive signal configured to drive a second group of one or more switching elements among the plurality of switching elements for providing a current to the discharge tube in a direction opposite to the current driven by the first drive signal;

an input terminal for inputting a synchronization pulse voltage signal; and a pulse current generation circuit configured to convert the synchronization pulse voltage signal inputted to the input terminal into a pulse current that alternates between positive and negative current values of the same absolute value at a duty of about 50% and superimpose the pulse current on the triangular wave signal of the oscillator, wherein the signal generation part generates the first drive signal and the second drive signal in synchronization with the frequency of the pulse current of the pulse current generation circuit.

9. The semiconductor integrated circuit as set forth in claim 8, wherein the frequency of the pulse current is a predetermined integer multiple of the frequency of the synchronization pulse voltage signal.

10. The semiconductor integrated circuit as set forth in claim 8, wherein the half period of the triangular wave signal is a rise inclination period or fall inclination period of the triangular wave signal.

11. The semiconductor integrated circuit as set forth in claim 8, wherein the half period of the triangular waveform is a period equal to or above a midpoint potential between an upper limit value and a lower limit value of the triangular wave signal, or a period below the midpoint potential.

* * * * *